US010801280B2

(12) United States Patent
Bouligny et al.

(10) Patent No.: US 10,801,280 B2
(45) Date of Patent: Oct. 13, 2020

(54) INTEGRATED TUBULAR HANDLING SYSTEM AND METHOD

(71) Applicant: Frank's International, LLC, Houston, TX (US)

(72) Inventors: Vernon Bouligny, New Iberia, LA (US); Jeremy R. Angelle, Youngsville, LA (US); Robert L. Thibodeaux, Lafayette, LA (US); Travis Lambert, Lafayette, LA (US); Timothy Bernard, Youngsville, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 17 days.

(21) Appl. No.: 16/260,961

(22) Filed: Jan. 29, 2019

(65) Prior Publication Data

US 2019/0153793 A1 May 23, 2019

Related U.S. Application Data

(63) Continuation-in-part of application No. 15/273,895, filed on Sep. 23, 2016, now Pat. No. 10,233,704.

(51) Int. Cl.
*E21B 19/16* (2006.01)
*E21B 19/10* (2006.01)
*E21B 19/06* (2006.01)

(52) U.S. Cl.
CPC ..... *E21B 19/161* (2013.01); *E21B 19/06* (2013.01); *E21B 19/10* (2013.01)

(58) Field of Classification Search
CPC ..... E21B 19/16; E21B 19/166; E21B 3/02; E21B 19/10; E21B 19/07; E21B 19/06; E21B 19/161
See application file for complete search history.

(56) References Cited

U.S. PATENT DOCUMENTS 5,664,310 A 9/1997 Penisson
6,223,629 B1 5/2001 Bangert
(Continued)

FOREIGN PATENT DOCUMENTS

WO 2015/061350 A1 4/2015
WO 2015/061350 A4 4/2015

OTHER PUBLICATIONS

Extended European Search Report dated Jan. 28, 2020, EP Application No. 17853576, pp. 1-6.
(Continued)

*Primary Examiner* — Brad Harcourt
(74) *Attorney, Agent, or Firm* — MH2 Technology Law Group LLP

(57) ABSTRACT

A tubular handling system and method, of which the system includes a power tong configured to engage and rotate an add-on tubular by applying a torque thereto, the power tong defining a central opening configured to receive the add-on tubular therethrough, a spider disposed at a rig floor, the spider being configured to support a tubular string, a lifting assembly coupled with the power tong and configured to move the power tong vertically with respect to the tubular string and the spider, and a control line guide coupled to the power tong. The control line guide is movable between an extended position in which the control line guide is configured to guide a control line into close proximity to the add-on tubular, and a retracted position in which the control line guide is configured to maintain a lateral control line clearance gap between the control line and the add-on tubular.

23 Claims, 34 Drawing Sheets

(56) References Cited

U.S. PATENT DOCUMENTS

| | | | | |
|---|---|---|---|---|
| 6,668,684 | B2 | 12/2003 | Allen et al. | |
| 6,752,004 | B2 | 6/2004 | Hawkins, III | |
| 6,814,149 | B2 | 11/2004 | Liess et al. | |
| 2008/0307930 | A1 | 12/2008 | Veverica et al. | |
| 2009/0008081 | A1 | 1/2009 | Bouligny | |
| 2009/0110535 | A1 | 4/2009 | Pietas et al. | |
| 2009/0151934 | A1 | 6/2009 | Heidecke | |
| 2010/0059231 | A1* | 3/2010 | Thomas | E21B 17/026 166/380 |
| 2012/0160517 | A1 | 6/2012 | Bouligny et al. | |
| 2012/0292010 | A1 | 11/2012 | Haugen | |
| 2014/0116687 | A1 | 5/2014 | Reumann | |
| 2014/0138080 | A1 | 5/2014 | Yorga | |
| 2015/0021946 | A1 | 1/2015 | Vierke et al. | |
| 2016/0123094 | A1* | 5/2016 | Amezaga | E21B 19/161 166/380 |
| 2016/0356102 | A1* | 12/2016 | Meeks | E21B 19/24 |

OTHER PUBLICATIONS

Jong Kyung Lee (Authorized Officer), International Search Report and Written Opinion dated Aug. 28, 2017, PCT Application No. PCT/US2017/037396, pp. 1-10.

Kihwan Moon (Authorized Officer), International Preliminary Report on Patentability dated Apr. 4, 2019, PCT Application No. PCT/US2017/037396, pp. 1-6.

* cited by examiner

INTEGRATED TUBULAR HANDLING SYSTEM AND METHOD

BACKGROUND

Tubular handling equipment is used on an oil rig to make up and lower casing and other tubulars into the wellbore ("trip-in"). During trip-in, an elevator picks up a length of one or more joints of tubular from a rack and brings the tubular into position above a "stump" or open connection of a previously-run tubular. The stump is typically supported at the rig floor by a spider, which supports the weight of the deployed tubular string at the rig floor. An operator may then guide the new length of tubular (an "add-on" tubular) into position over the stump (i.e., at well center). The operator may then assist in stabbing the add-on tubular into the open connection of the stump.

Once this occurs, the operator may engage a power tong onto the new tubular to make-up the add-on tubular to the string via the power tong. The torque applied by the power tong causes the new tubular to rotate into connection with the stump. The stump is generally held rotationally stationary by a backup tong. The elevator may then engage the new tubular, after the new tubular is made up to the remainder of the string, and the spider may disengage from the tubular string, leaving the weight of the tubular string to be supported by the elevator. The elevator may then lower the tubular string into the well, until nearing the rig floor, at which point the spider may be re-engaged, and the process starts again. This is typically a labor-intensive process and generally includes one or more workers exposed at the rig floor and manually handling extremely heavy machinery.

Additionally, casing strings (or other tubular strings) may be equipped with control lines for mechanically, electrically, pneumatically, hydraulically, or optically linking various downhole devices to the surface. Control lines may be used to receive data from downhole instruments or to operate downhole devices such as valves, switches, sensors, relays or other devices. Control lines may be used to open, close or adjust downhole valves in order to selectively produce or isolate formations at locations deep in the well. A control line may transmit data gathered downhole to the surface or communicate commands to downhole devices to take samples, readings, or to stroke valve. Control lines may include electrically conductive wires or cables, optical fibers, or fluid conduits for pneumatically or hydraulically controlling downhole devices or transmitting data.

Control lines are generally of a small diameter relative to the diameter of the tubular string to which they are secured, and are generally between 0.5 and 6 cm in diameter. Multiple control lines may be aggregated to form an umbilical having a diameter of up to 10 cm or more. Control lines are generally secured along the length of the outer surface of a pipe string, generally parallel to the center axis of the bore of the pipe string. Continuous control lines are secured to the pipe string and installed in the well as joints of pipe are made up into a pipe string and run into a well.

Control lines secured to pipe string are subject to being damaged and being rendered useless if they are pinched or crushed by the pipe slips used to grip and support the pipe string while it is being made up and run into the well. This presents a challenge in securing the control lines to the pipe string as it is made up and run into the borehole. Depending on the diameter, length and pipe thickness, the pipe string may weigh more than four hundred thousand pounds. A pipe-gripping tool called a spider is used to grip and support the pipe string at or near the rig floor. The spider generally includes a tapered bowl having a bore with an axis that is generally aligned with the borehole. The pipe string passes through the tapered bowl, and the tapered howl receives a generally circumferential arrangement of radially inwardly movable slips that surround and engage the pipe string within the tapered bowl. The generally wedge-shaped slips are adapted for engaging the outer curved surface of the pipe string and bearing against the tapered inner surface of the bowl to provide generally radially distributed support in a self-tightening manner.

The pipe slips in the spider generally uniformly grip and support the pipe string in order to minimize localized stress and loads on the pipe that may crush or damage the pipe string. The radially inwardly disposed gripping surfaces of the slips are concave in order to contact the pipe over a radially large area to minimize localized stresses. When control lines are being secured to the pipe and run into the borehole, care is taken to prevent the control lines from being pinched or trapped between the spider slips and the outer surface of the pipe string, or between adjacent slips as they move radially inwardly to grip and support the pipe string. If a control line is trapped between the slips and the pipe string or between two adjacent slips, the control line may be damaged with a resulting loss or impairment of surface control of or communication with, downhole devices or instruments that are linked to other devices or to the surface using control line(s).

SUMMARY

A tubular handling system is disclosed. The system includes a power tong configured to engage and rotate an add-on tubular by applying a torque thereto, the power tong defining a central opening configured to receive the add-on tubular therethrough, a spider disposed at a rig floor, the spider being configured to support a tubular string, a lifting assembly coupled with the power tong and configured to move the power tong vertically with respect to the tubular string and the spider, and a control line guide coupled to the power tong. The control line guide is movable between an extended position in which the control line guide is configured to guide a control line into close proximity to the add-on tubular, and a retracted position in which the control line guide is configured to maintain a lateral control line clearance gap between the control line and the add-on tubular.

A method for handling tubulars is also disclosed. The method includes positioning a control line guide of a tubular handling system in a retracted position such that a control line clearance gap is defined laterally between a control line that is run through the control line guide and at least part of a tubular string that is received through and engaged by a spider of the tubular handling system, moving a power tong of the tubular handling system upwards along the tubular string, past an upper connection thereof, and around an add-on tubular to be connected to the tubular string, by expanding a lifting assembly of the tubular handling system and without laterally moving the power tong from around the tubular string, rotating the add-on tubular using the power tong, to connect a lower connection of the add-on tubular to the upper connection of the tubular string, such that the add-on tubular becomes part of the tubular string, extending the control line guide to an extended position such that the control line clearance gap is reduced or eliminated and at least a portion of the control line guide is brought into proximity with the tubular string, disengaging the power tong from the add-on tubular, lowering the power tong past the lower connection of the add-on tubular and the upper connection of the tubular string by collapsing the lifting assembly, without laterally moving the power tong from around the tubular string, such that the power tong is positioned proximal to the spider, disengaging the spider from the tubular string, and lowering the tubular string, including the add-on tubular, through the spider and the power tong.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
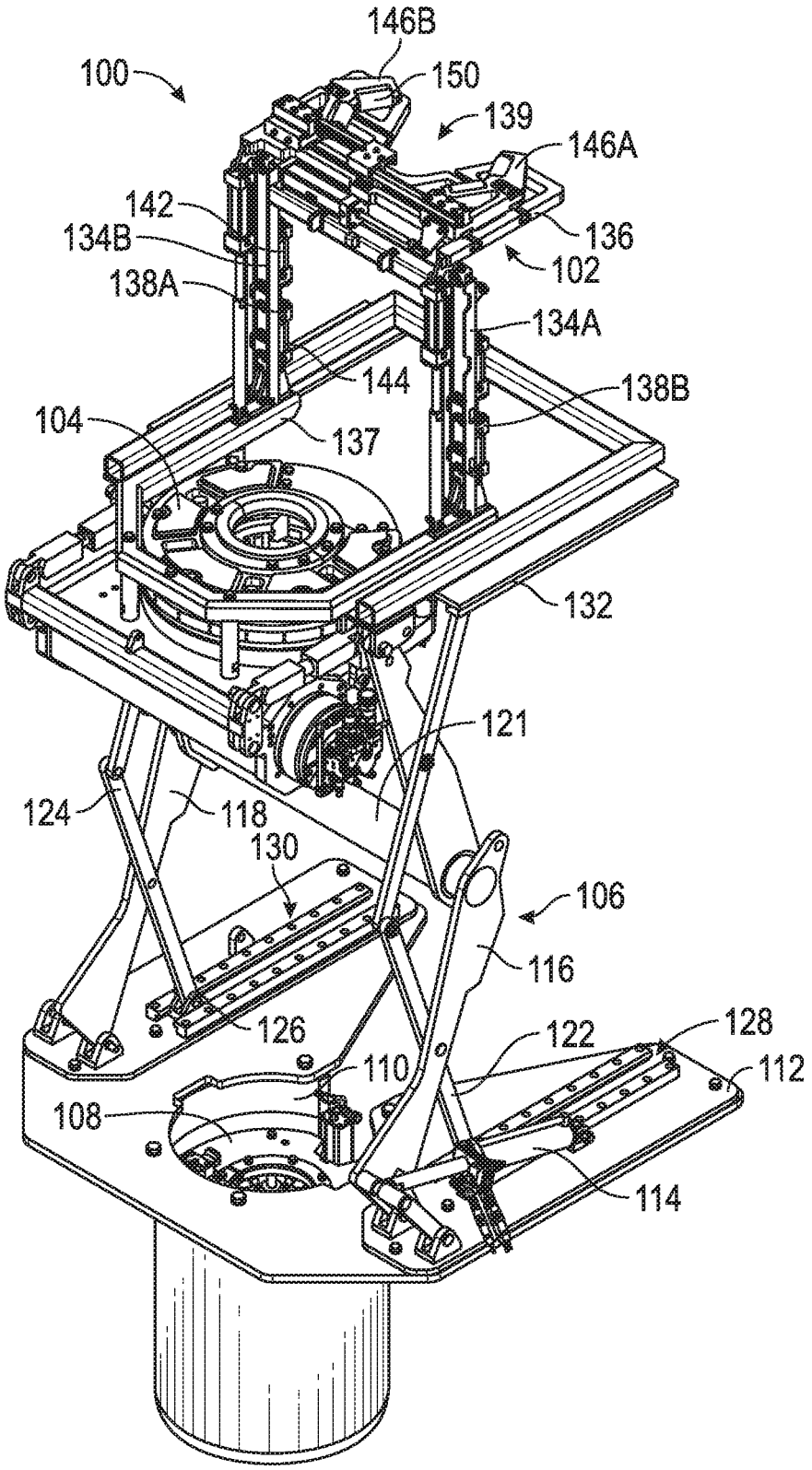
FIG. 1 illustrates a perspective view of a first tubular handling system, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawings. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

In general, the present disclosure provides a tubular handling system that includes a spider, a power tong, a lifting assembly for the power tong, and a boxing device. These components are configured to operate in concert to reduce manual manipulation of the various pieces of equipment used to handle, make-up, and support the tubular string being run. The assembly provides for reliable acceptance and positioning of a new or "add-on" tubular, using the boxing device, while the spider holds the "stump" (i.e., previously-run tubular string) at the rig floor.

The power tong has retractable jaws, allowing it to be lifted above the stump, past the tubular connections, centralizers, and other tools that may be attached to the tubulars, and into engagement with the add-on tubular. In at least some embodiments, the power tong of the assembly is movable vertically past the connections of the tubular string, and thus may not need to be moved laterally onto and off of the tubular string when new tubulars are added. The power tong is then employed to rotate the new tubular, such that the new tubular is threaded into the stump. Reactionary torque of the power tong is supported either by a spider with torque-holding capacity or by a backup tong incorporated into the system. The assembly then collapses to allow the elevator to lower the tubular string through the power tong and the spider into the well, and then the spider re-engages the tubular string once the elevator and string have been lowered.

Turning now to the illustrated embodiments, FIG. 1 depicts a raised perspective view of a first tubular handling system 100, according to an embodiment. The system 100 includes a boxing device 102 for positioning an add-on tubular above a well center, a power tong 104 for rotating and applying torque to the add-on tubular, which is received through the central opening thereof, a lifting assembly 106 for lifting the power tong 104, and a spider 108 received into a rotary 110 connected to a rig floor. The rotary 110 may be a rotary table or a rotary bushing positioned within the opening of the rotary table. The system 100 may be configured to support running of any type of tubular, such as casing, drill pipe, completion tubing, or the like. For convenience, the system 100 will be described herein with reference to casing, which may be lowered via one or more elevators, with each joint (or a stand thereof) being hoisted and moved into position by a secondary (e.g., "single joint") elevator. It will be appreciated though that this system 100 may be readily applied to other drilling operations.

In an embodiment, the lifting assembly 106 includes a base plate 112, which may be secured to the rotary 110. The lifting assembly 106 may also include one or more structures configured to raise the power tong 104 with respect to the base plate 112 (and/or with respect to the rotary 110). In the illustrated embodiment, the lifting assembly 106 may include a linear actuator 114, such as, for example, a hydraulic actuator, for this purpose. The linear actuator 114 may be linked with lifting arms 116, 118. The lifting arms 116, 118 may be pivotally connected to guide arms 122, 124, respectively, and pivotally connected to the base plate 112. Further, the lifting arms 116, 118 may be connected together via a cross-member 121, such as a cylindrical bar or tube (as shown), which may prevent twisting of the lifting arms 116, 118.

The guide arms 122, 124 may include slidable feet 126, which may be disposed in a channel 128, 130, thereby controlling the lifting of the lifting assembly 106. At the top side, the lifting assembly 106 may include a lifting frame 132, which may be coupled with the lifting arms 116, 118, the guide arms 122, 124, the power tong 104, and the boxing device 102. Slidable feet may also be provided at the pivoting connection between the guide arms 122, 124 and the lifting frame 132. Accordingly, actuation (i.e., extension or retraction) of the linear actuator 114 may be translated into vertical movement of the lifting frame 132, and thus vertical movement of the boxing device 102 and the power tong 104. In an embodiment, the lifting assembly 106 may be movable from a collapsed configuration, in which the lifting arms 116, 118 are pivoted together and positioned at or near the base plate 112, to an extended position, in which the lifting arms 116, 118 extend upwards, e.g. such that the lower portion of the lifting arms 118 forms an angle of between about 45 degrees and about 80 degrees with respect to the base plate 112. Further, the lifting assembly 106 may be configured to hold the power tong 104 at a range of elevations above the spider 108, between the extended and collapsed configurations.

Although described and illustrated as a type of scissor-jack arrangement, it will be appreciated that the lifting assembly 106 may, in some embodiments, take on other forms of kinematic linkage lifting mechanisms. Moreover, it will be appreciated that the linear actuator 114 may be substituted or augmented with any suitable type of actuator, and one or more additional actuators 114 (e.g., an actuator attached directly to the lifting arm 118) may be employed.

Turning now to the boxing device 102 positioned above the power tong 104, the boxing device 102 may include two or more arms 134A, 134B, an upper frame (e.g., a plate) 136, and a base 137. The base 137 may be coupled with the lifting frame 132 and/or the power tong 104. The arms 134A, 134B may be pivotally coupled with the base 137 and the upper frame 136.

Further, the boxing device 102 may include one or more actuators (two are shown: 138A, 138B, one along each arm 134A, 134B, respectively), which may be pivotally coupled with the upper frame 136 and the base 137. The actuators 138A, 138B may either or both be hydraulic, pneumatic, electric, etc. In an embodiment, each actuator 138A, 138B may include a primary actuator 142 and a secondary actuator 144. The upper frame 136 may form a recess 139, which may be configured to laterally receive a tubular (e.g., casing), as will be described in greater detail below.

In operation, the boxing device 102 may move between a collapsed configuration and an extended position by operation of the linear actuator 138A, 138B. For example, in the collapsed configuration, the boxing device 102 may have a minimal vertical height, e.g., the arms 134A, 134B may be pivoted toward the lifting frame 132, e.g., by retraction of the linear actuator 138A, 138B, and the upper frame 136 may accordingly rest at or near the lifting frame 132. The boxing device 102 may also have a neutral or "well centered" position, in which the boxing device 102 is configured to center a tubular received into the recess 139 on the well, as will be described in greater detail below.

The boxing device 102 may also include grippers 146A, 146B, which may be movable along the upper frame 136, e.g., under force applied by a linear actuator (e.g., a hydraulic, pneumatic, or electric actuator). For example, the grippers 146A, 146B may be configured to be brought together to grip part of the tubular received into the recess 139. The grippers 146A, 146B may also include rollers 150, or other friction-reducing members, to facilitate movement of the tubular therethrough, while providing lateral stability.

Figure 2:
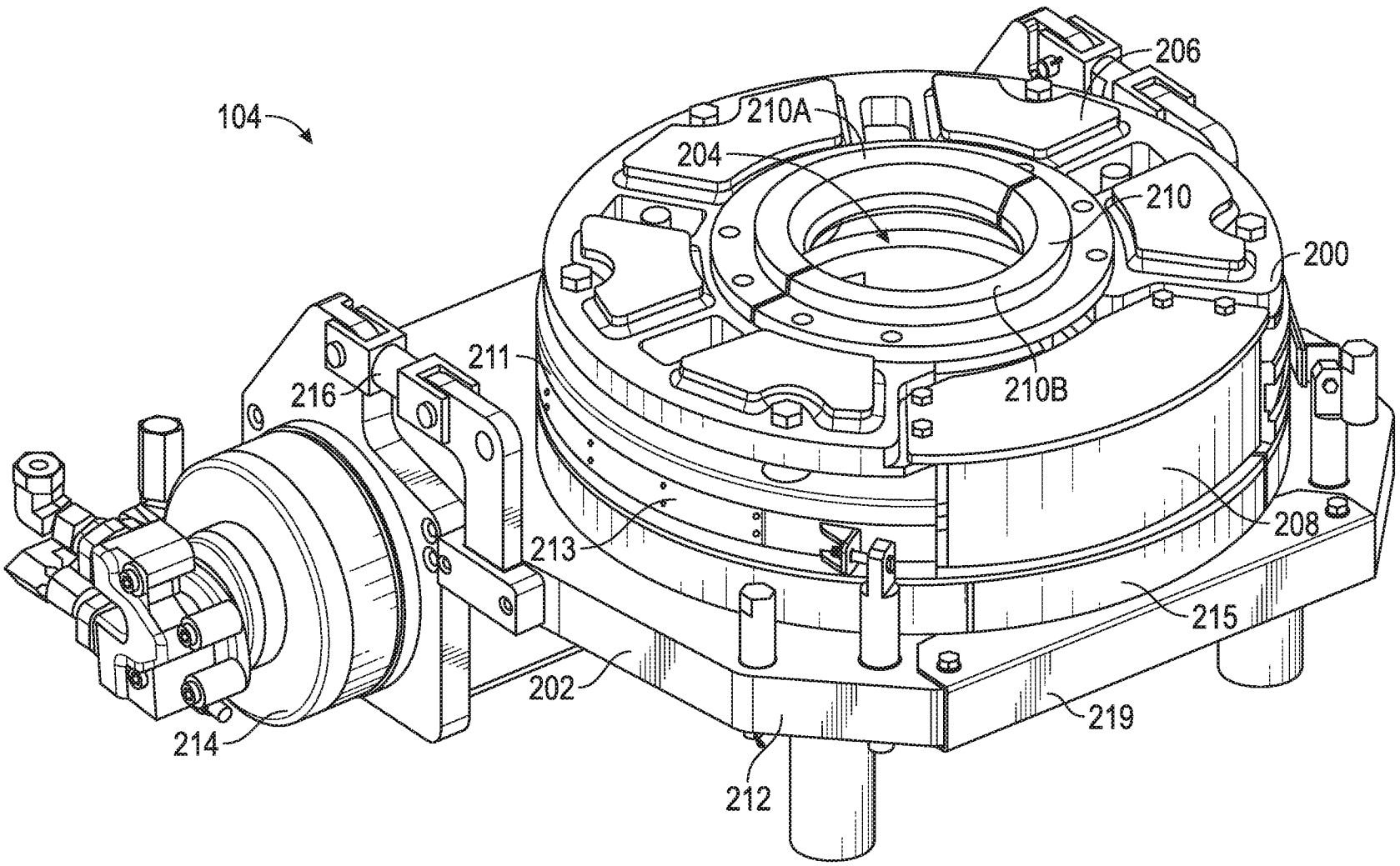
FIG. 2 illustrates a perspective view of a power tong of the tubular handling system, according to an embodiment.

Considering the power tong 104 in greater detail, FIG. 2 illustrates a raised, perspective view of an exterior of the power tong 104, according to an embodiment. The power tong 104 may include a rotatable gripping section 200 and a stationary support section 202, which may form at least a portion of a body 212 of the power tong 104. The rotatable section 200 may be annular and may include a central opening or receiving opening 204 therethrough. As will be described in greater detail below, the power tong 104 may include jaws or any other type of engaging structures that extend radially into the receiving opening 204 to grip a tubular received therethrough.

The rotatable section 200 may include a top guard 206, which may be generally disk-shaped and may serve to protect other power tong 104 components from damage, e.g., if an elevator or another object lands on the power tong 104. Further, the rotatable section 200 may include a guide 210, which may be coupled with or disposed within the top guard 206. The guide 210 may be annular and beveled or tapered, so as to receive and direct an end of a tubular therethrough. The guide 210 may be positioned in alignment with the receiving opening 204, and thus may serve to guide the tubular into the receiving opening 204. Further, the guide 210 may be provided in at least two pieces (e.g., segments 210A, 210B), which may be separately removable.

The stationary support section 202 may include a device configured to measure a torque on the power tong 104. In an embodiment, such torque-measuring device may be provided in the form of a load cell 216 configured to measure a torque applied thereto. The measured torque may provide information about the torque load applied by the power tong 104 onto a tubular connection, thereby indicating when the connection is fully made up. In an embodiment, the motor 214 may be a hydraulic or electric motor, but in other embodiments, other types of drive systems may be employed.

Figure 3:
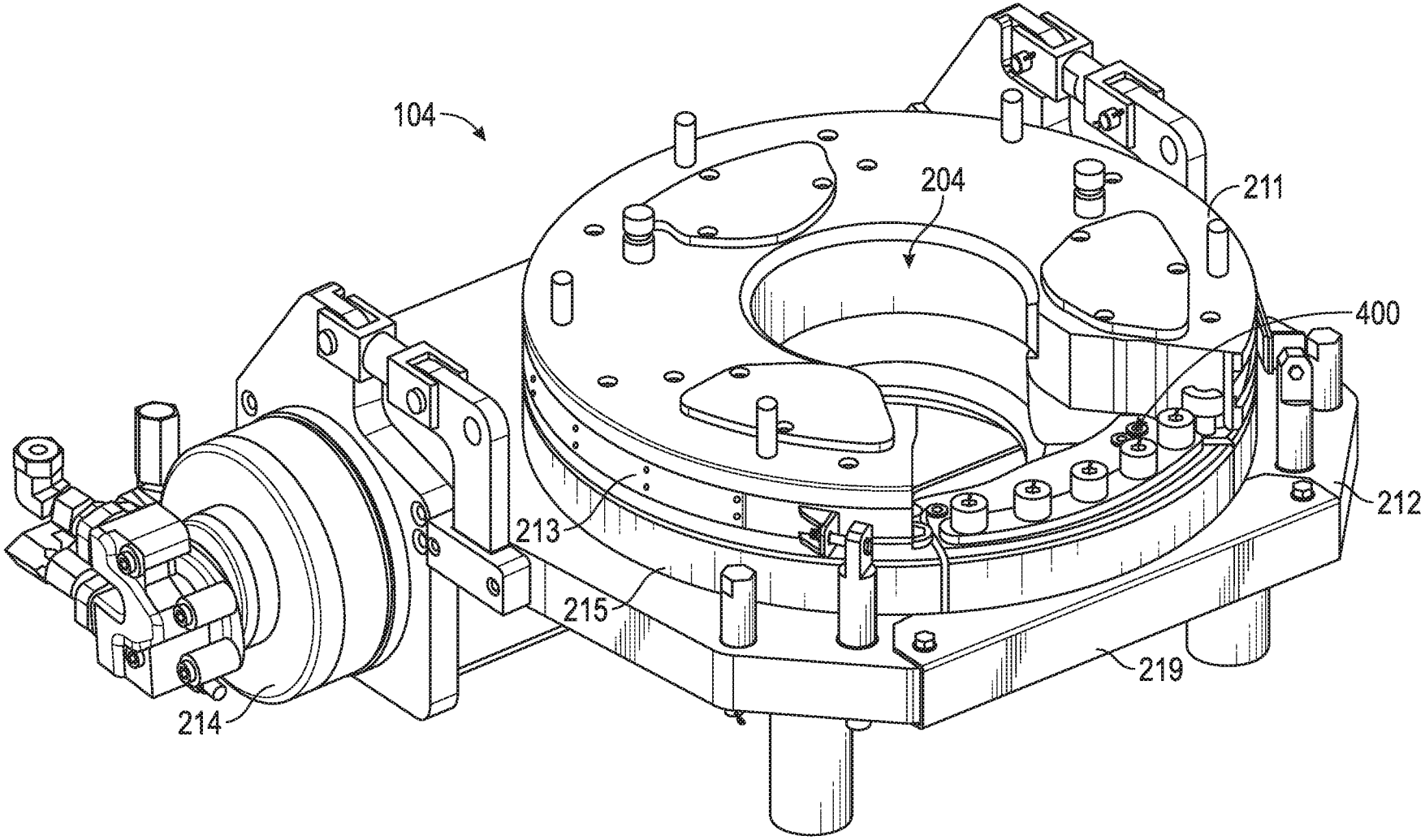
FIG. 3 illustrates a perspective view of the power tong with a top guard thereof removed, according to an embodiment.

FIG. 3 illustrates a raised perspective view of the power tong 104 with the top guard 206 removed for purposes of illustration, according to an embodiment. As noted above, the top guard 206 may include the cover 208 (FIG. 2). The cover 208 covers an access door 400, which may be formed by a gap in the cage plate 211. The rotary ring 215 may extend through the access door 400, but a portion thereof may be removable, e.g., along with a door 219, so as to allow lateral entry or exit of a tubular into the receiving opening 204, e.g., to allow removal of the power tong 104 from around the tubular.

Figure 4:
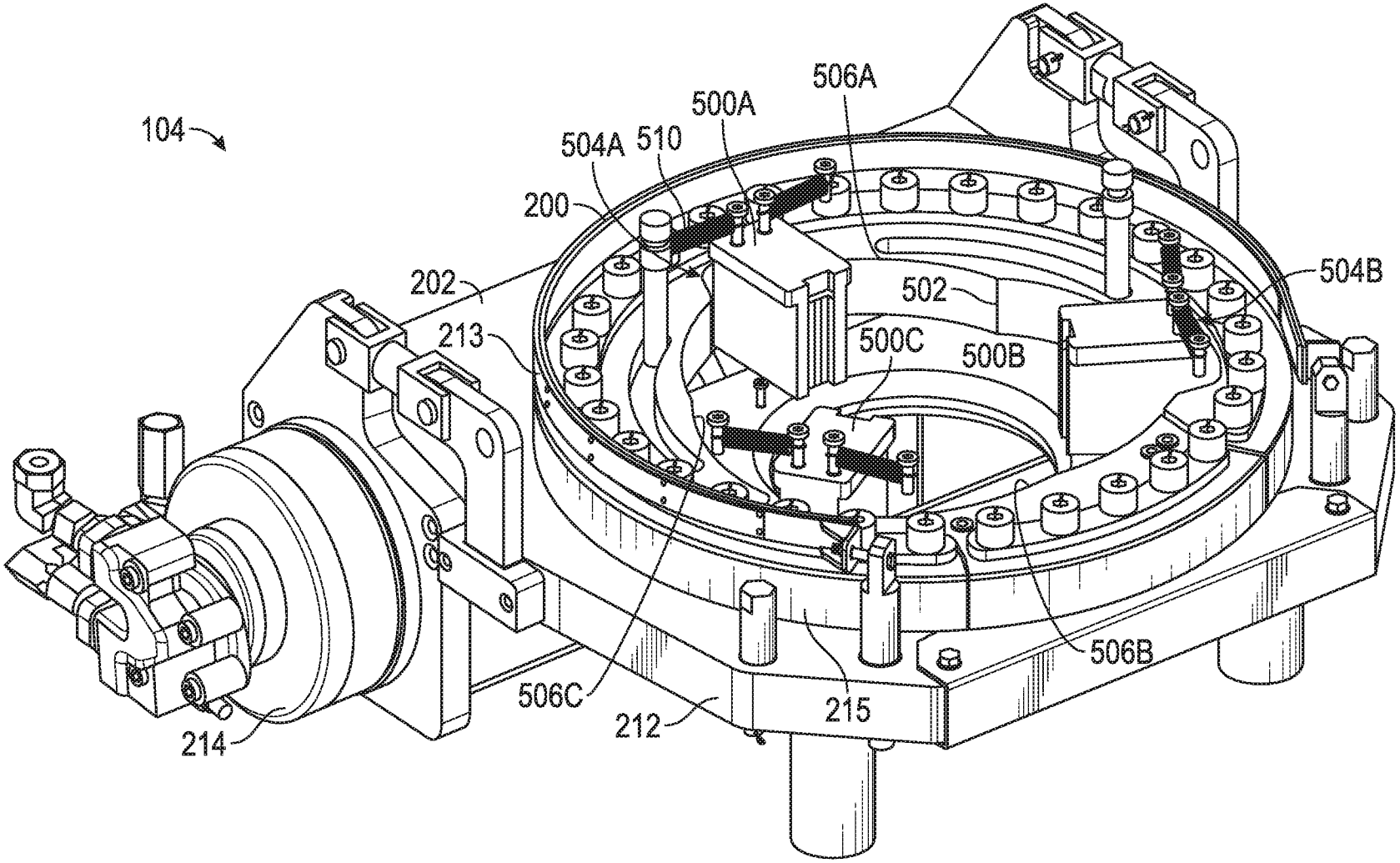
FIG. 4 illustrates a perspective view of the power tong with the top guard and a cage plate thereof removed, according to an embodiment.

FIG. 4 illustrates a raised perspective view of the power tong 104 with the top guard 206 and the cage plate 211 removed, for purposes of illustration, according to an embodiment. The power tong 104 may include one or more jaws (three shown: 500A, 500B, 500C), which may be movable to grip a tubular. The jaws 500A-C may thus include teeth, wickers, buttons, grit, high-friction surfaces, or any other structure configured to transmit a high radial and torque load to the tubular. The jaws 500A-C may be coupled with the cage plate 211 (FIG. 4), and may be configured to slide radially, between a retracted position and an engaging position, with respect thereto.

The jaws 500A-C are illustrated in the retracted position. In particular, in this embodiment, the rotary ring 215 includes an inner diameter 502 in which one or more pockets (three are shown: 504A, 504B, 504C) are defined, for example, one for each of the jaws 500A-C. The pockets 504A-C may extend radially outward from the inner diameter 502, providing a location into which the jaws 500A-C may be retracted and held away from the tubular received through the receiving opening 204. Thus, the pockets 504A-C may allow the jaws 500A-C to retract, which may allow the power tong 104 to slide over tubular connections, etc. The inner diameter 502 may also include one or more camming surfaces (three shown: 506A, 506B, 506C), which may be arcuate segments that extend radially inwards as proceeding in a circumferential direction around the inner diameter 502 of the rotary ring 215.

In operation, the rotary ring 215 may be driven to rotate relative to the body 212 by the motor 214, which may be hydraulic, electric, etc. The jaws 500A-C may be coupled with the cage plate 211 such that they are non-rotational but radially slidable relative to the cage plate 211. The cage plate 211 may be initially secured against rotation by friction forces applied by the brake band 213. Thus, as the rotary ring 215 begins to rotate relative to the body 212, the rotary ring 215 may also rotate relative to the jaws 500A-C. By such rotation, the jaws 500A-C may be forced out of the pockets 504A-C and radially inward onto the camming surfaces 506A-C. Continued rotation may cause the jaws 500A-C to move farther radially inward until reaching an engaging position, where the jaws 500A-C are designed to engage a tubular received in the receiving opening 204.

When the jaws 500A-C engage a tubular, a force between the jaws 500A-C and the camming surfaces 506A-C may increase, as the camming surfaces 506A-C wedge the jaws 500A-C tighter against the tubular. This may eventually overcome the holding force applied on the cage plate 211 by the brake band 213. Thus, as the rotary ring 215 continues to rotate, the jaws 500A-C and the cage plate 211 may also rotate. Further, this may also cause the tubular engaged by the jaws 500A-C to rotate with respect to the body 212.

When release of the tubular is desired, the rotation of the rotary ring 215 may reverse. Upon reverse rotation of the rotary ring 215, the return springs 510 may hold the jaws 500A-C radially outwards against the camming surface 506A-C and eventually force the jaws 500A-C back into the pockets 504A-C. The pockets 504A-C may thus allow the jaws 500A-C to retract, which may allow the power tong 104 to remain received around a tubular while providing an opening 204 sized and configured to allow for passage of a tubular collar. Power tongs of other designs that allow for vertical passage of the tubular and collar through the opening may also be employed with the system 100.

Figure 5:
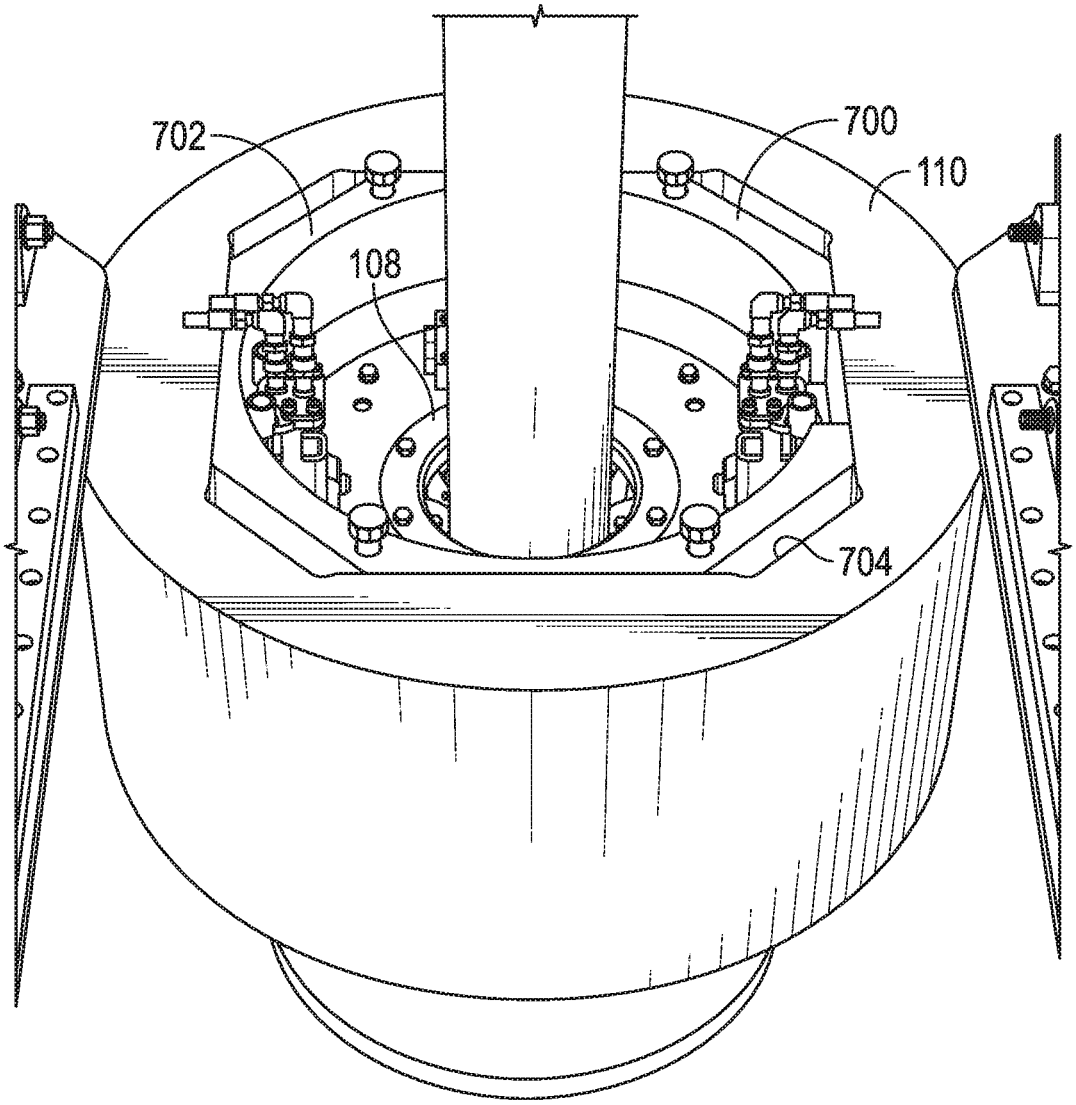
FIG. 5 illustrates a perspective view of a rotary with a spider disposed therein, according to an embodiment.

Turning now to the illustrated embodiment of the spider 108, which may fit into the central opening of a rig rotary table or rotary, as mentioned above with respect to FIG. 1, FIG. 5 illustrates a perspective view of such a spider 108 positioned within the rotary 110, according to an embodiment. The system 100 (FIG. 1) also includes a can 700, which may be positioned radially between the spider 108 and the rotary 110. In an embodiment, the can 700 may include a rotary flange 702 that includes two or more flat sides. For example, the rotary flange 702 may be polygonal, e.g., generally octagonal as shown. The rotary 110 may include an inner surface 704 that also includes one or more flat sides, e.g., forming an octagon or another type of polygon. The rotary flange 702 of the can 700 and the inner surface 704 of the rotary 110 may fit together, so as to prevent relative rotation of the can 700 and the rotary 110. In this way, torque may be transmitted between the can 700 and the rotary 110. Further, the spider 108 may be positioned down in the rotary 110, such that top of the spider 108 may extend radially upwards without extending past the top of the rotary 110.

Figure 6:
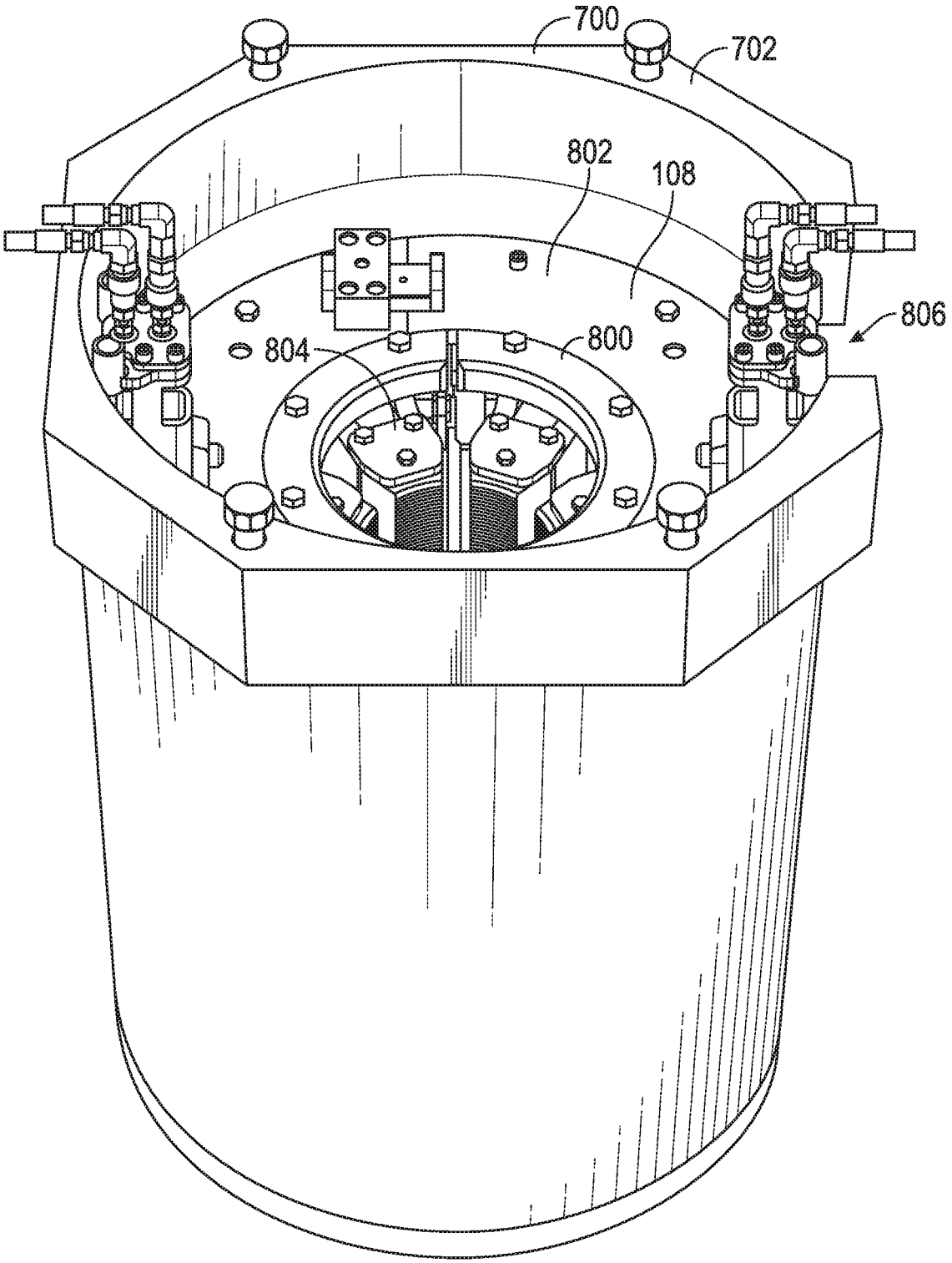
FIG. 6 illustrates a perspective view of a support can with a spider disposed therein, according to an embodiment.

FIG. 6 illustrates a perspective view of the spider 108 in the can 700, removed from the rotary 110 (FIG. 5), according to an embodiment. The spider 108 may include a guide ring 800. Further, the spider 108 may include a slip-moving mechanism, such as a timing ring 802, to which slips 804 of the spider 108 may be attached. The slips 804 may be pivotally coupled with the timing ring 802, so as to raise and lower therewith. The spider 108 is illustrated with the slips radially-retracted, e.g., by raising the slips 804 out of the inwardly-tapered bowl of the spider 108. As can be seen, the timing ring 802 remains below the rotary flange 702 with the slips 804 raised.

Further, the can 700 includes an open door 806, which may extend along the height of the can 700. The open door 806 may allow for removal of the can 700 (e.g., along with the rest of the system 100), for example, upon completion of run-in, or at any other suitable time. The open door 806, along with the segmented structure of the power tong 104 described above, and the segmented structure of the spider 108, as will be described below, may cooperate to allow system 100 to be removed while the tubular string is supported by an elevator.

Figure 7A:
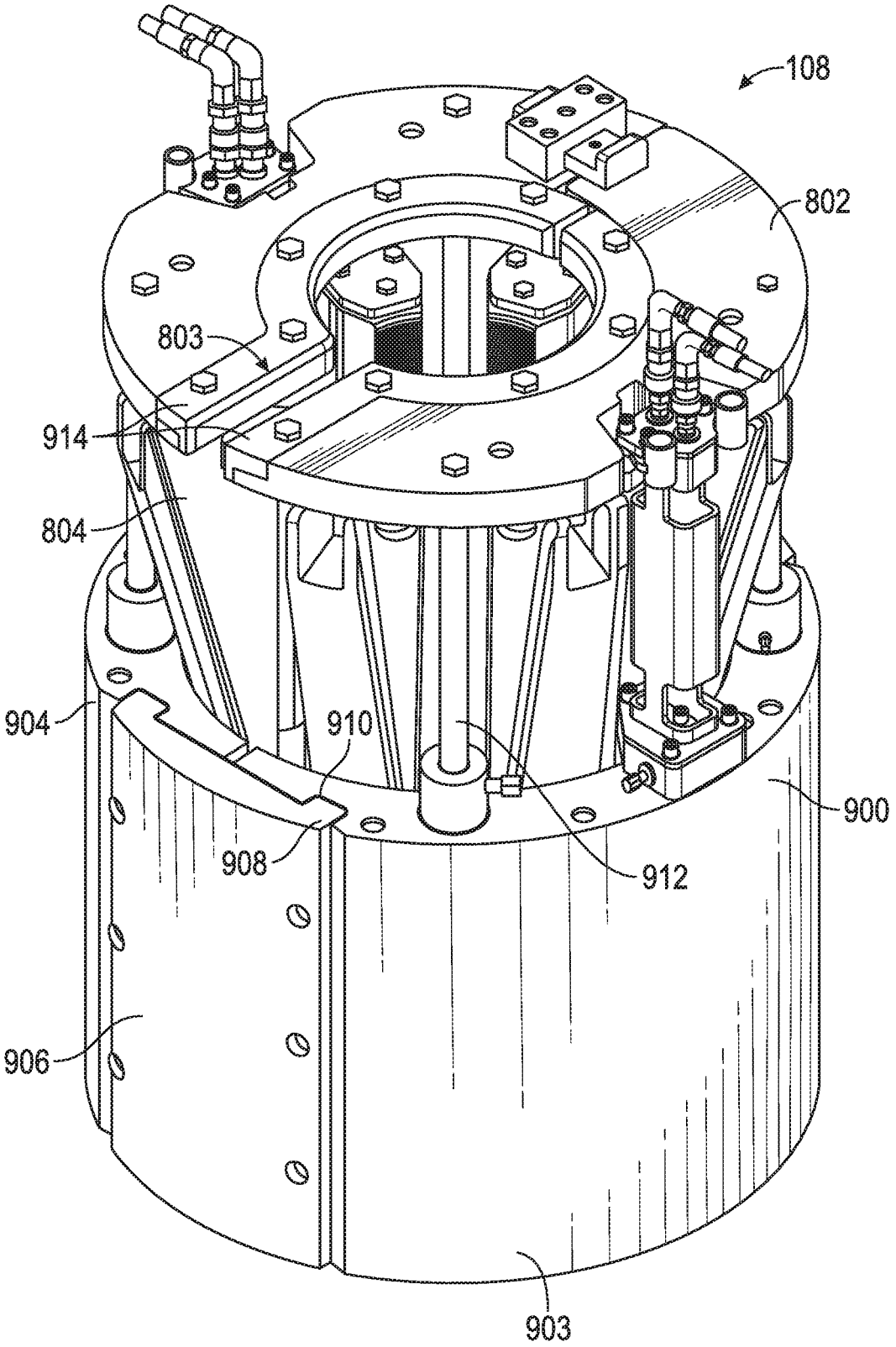
FIG. 7A illustrates a perspective view of pipe-gripping slips in a disengaged position, according to an embodiment.
Figure 7B:
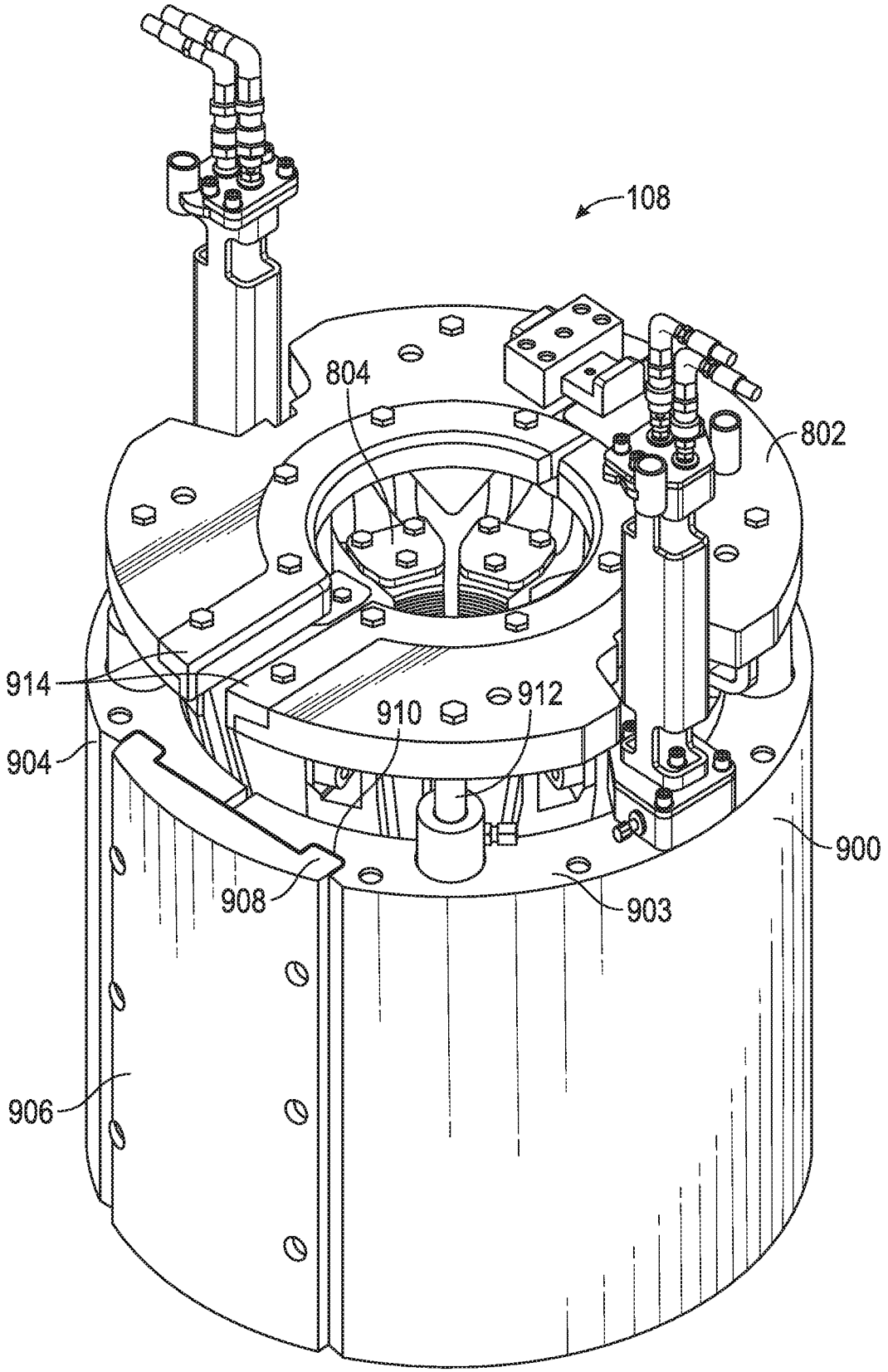
FIG. 7B illustrates a perspective view of the pipe-gripping slips in an engaged position, according to an embodiment.

FIGS. 7A and 7B illustrate perspective views of the spider 108 removed from the can 700 and in a retracted position and an engaging position, respectively. The timing ring 802 of the spider 108 may include a control-line gap 803. The control-line gap 803 may be aligned with one or more control-line pockets in the can 700 (FIG. 6), e.g., through the bottom of the can 700. The control-line gap 803 may thus be provided to accommodate control/data sensing lines that are affixed to the tubular string and run downhole along with the tubular string, so that these control lines are not pinched or damaged by the slips of the spider when the spider slips grip and support the tubular.

The spider 108 may further include a body 900, which may be separated into two or more segments 903, 904. The segments 903, 904 may be held together by one or more keyed doors 906, which may, for example, include legs 908 received into grooves 910 formed in the segments 903, 904. The keyed doors 906 may be located 180 degrees apart, for example, around the body 900. As noted above, this segmented structure of the spider 108 may allow for separation and lateral removal of the spider 108 from a tubular received therein (or vice versa). Further, the body 900 may define a conical or tapered bore therein, along which the slips 804 may slide, such that, as the segments 903, 904 move downward relative to the body 900, the slips 804 are pushed radially inwards, e.g., to grip the tubular string.

Further, the body 900 may be coupled with one or more extendable cylinders 912. The extendable cylinders 912 may also be coupled with the timing ring 802 and may be operable to adjust the distance between the body 900 and the timing ring 802. The slips 804, as noted, above, may follow the timing ring 802, and may thus be raised or lowered with respect to the body 900 via the cylinders 912. The cylinders 912 may be hydraulically, pneumatically, mechanically, electro-mechanically, or otherwise actuated. As the slips 804 are lowered into the body 900 (e.g., from FIG. 7A to FIG. 7B), the slips 804 may move radially inwards and into engagement with a tubular received through the body 900. The slips 804 may have teeth, jaws, wickers, grit, high-friction material, buttons, etc., that may grip the tubular and prevent relative rotation between the slips 804 and the tubular. Further, the cylinders 912 may be sized and configured to cause the slips 804 to apply an initial radial gripping force to the tubular, e.g., during early trip-in while the drill string has a relatively low weight.

The spider 108 may also include one or more control-line guards (e.g., made from an appropriate nonabrasive material). Further, a top guard 914, which may allow for passage of a control line therethrough, may also include a protective layer of a non-abrasive material, e.g., to avoid damaging such a control line.

Figure 8:
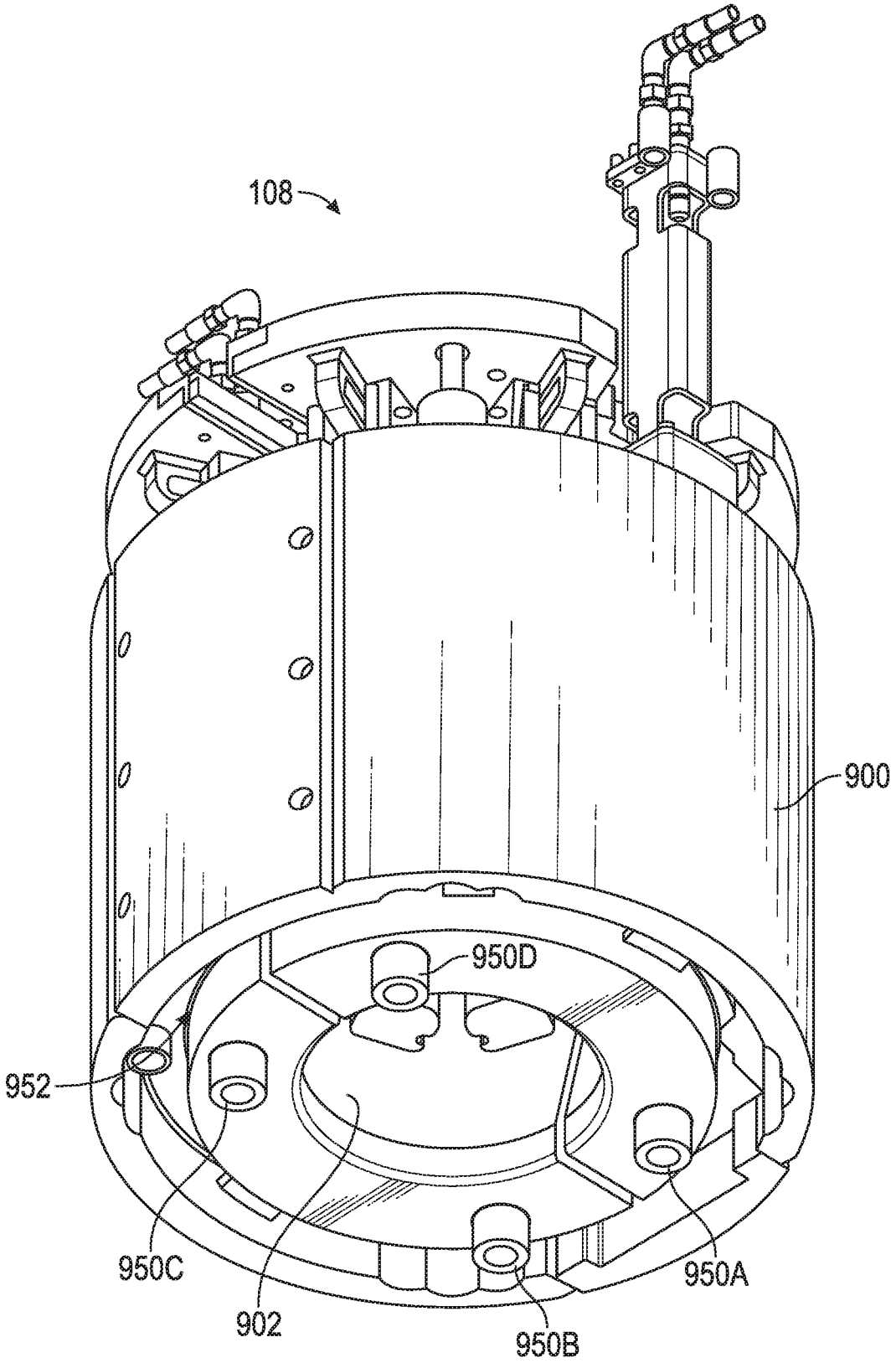
FIG. 8 illustrates a perspective view of a bottom of the spider, according to an embodiment.

FIG. 8 illustrates another perspective view of the spider 108, showing the bottom thereof, according to an embodiment. The body 900 may include a frustoconical bowl interior shape, as mentioned above. As such, the body 900 may provide a tapered inner surface 902 against which the slips 804 may slide, such that the slips 804 may move radially inwards as they are lowered with respect to the body 900.

The body 900 may also include two or more lugs (four shown: 950A, 950B, 950C, 950D). The lugs 950A-D may be received into corresponding pockets of the can 700, and may thus transmit torque between the body 900 and the can 700. Furthermore, the lugs 950A-D may be sized smaller than the pockets of the can 700, which may provide a range of motion for the spider 108 within the can 700 and thus with respect to the rotary 110 and the rig floor. In addition, the bottom of the body 900 may be provided with a machined annular space 952 for hydraulic or pneumatic lines used to transfer hydraulic fluid or compressed air (or another gas) to cylinders 912 to extend and retract the cylinders 912.

Figure 9:
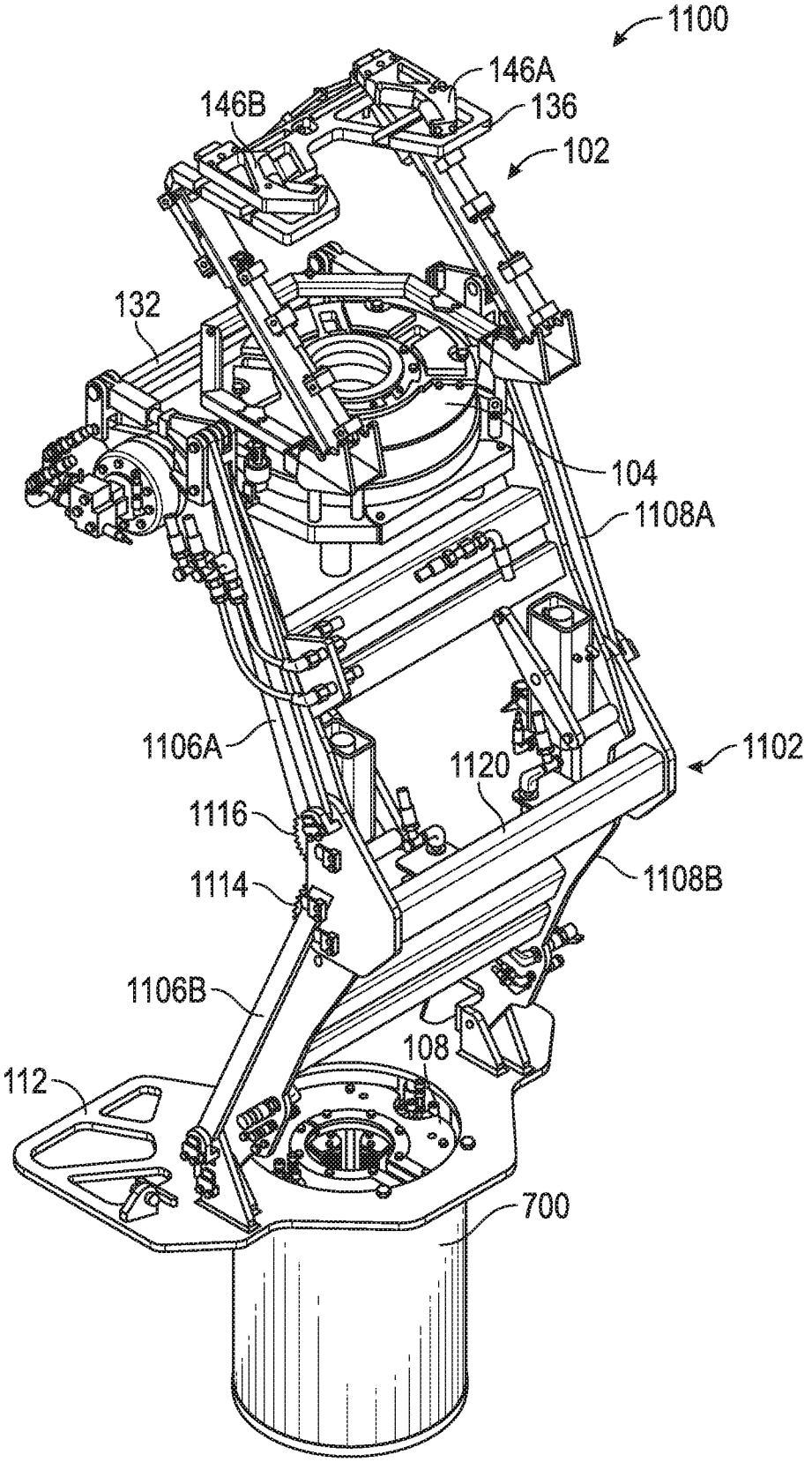
FIG. 9 illustrates a perspective view of a second tubular handling system in an extended position, according to an embodiment.
Figure 10:
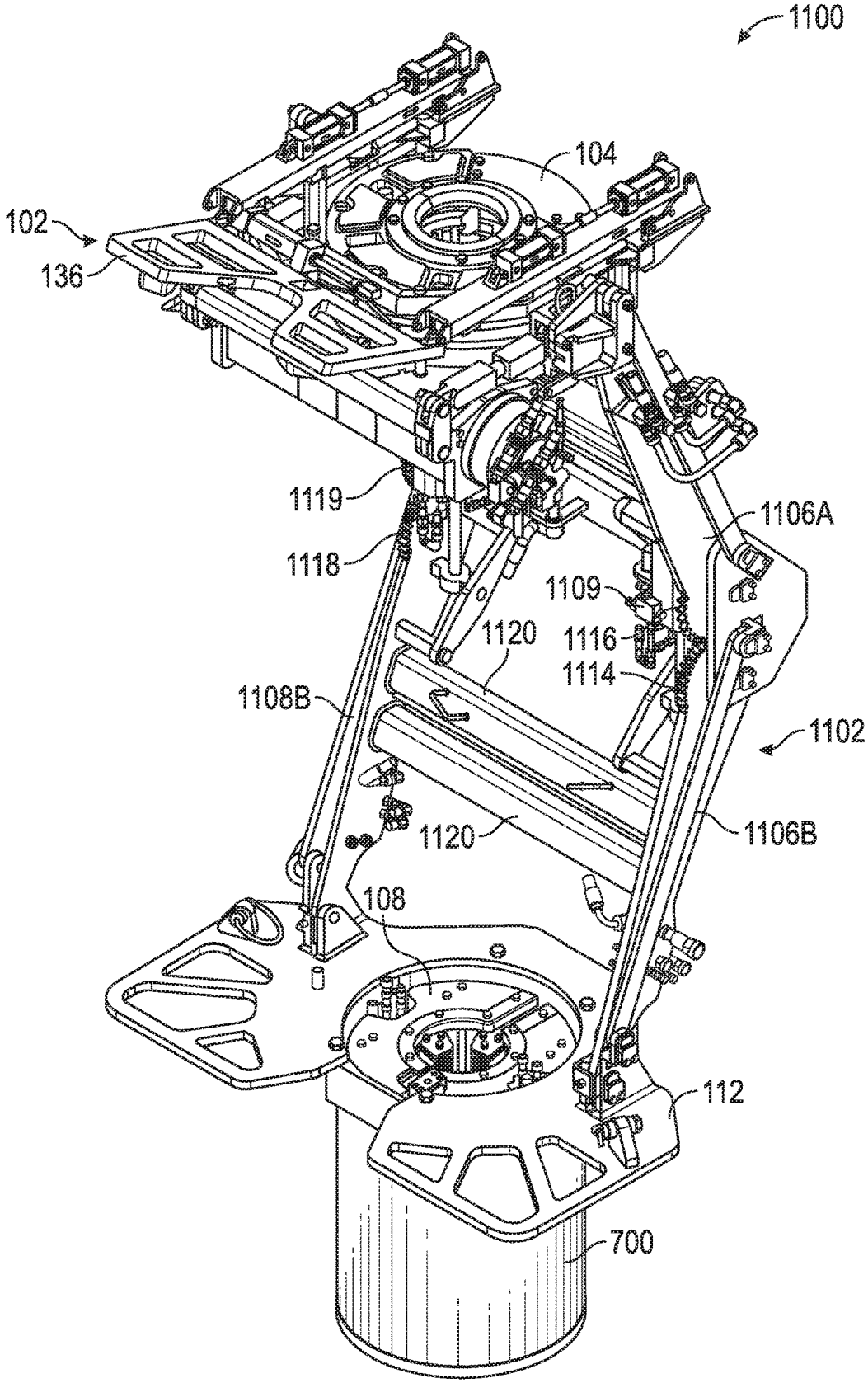
FIG. 10 illustrates another perspective view of the second tubular handling system, according to an embodiment.

FIGS. 9 and 10 illustrate two perspective views of a second tubular handling system 1100 in an extended position, according to an embodiment. The tubular handling system 1100 may include several of the same or similar components as the tubular handling system 100. At least some such similar components are given the same reference numerals in FIGS. 9-15B as in FIG. 1 and duplicative descriptions thereof are omitted herein.

In the embodiment shown, the system 1100 may include a lifting assembly 1102, extending between the can 700 (or the rotary 110, not shown here) and the power tong 104, for lifting the power tong 104. Rather than (or in addition to) a scissor lift, the lifting assembly 1102 may include a "four-bar linkage" type of lifting device. In particular, the lifting assembly 1102 may include a first pair of lifting arms 1106A, 1106B, and a second pair of lifting arms 1108A, 1108B. The arms 1106A,B, 1108A,B, may be pivotably connected to one another, such that an angle formed therebetween may move between, for example, about 0 degrees and about 150 degrees (or more). As the angle increases, the distance between the power tong 104 and the base plate 112 may increase, thereby raising the power tong 104. The lower arms 1106B, 1108B may be pivotably connected to the base plate 112, and the upper arms 1106A, 1108A may be pivotally connected to the power tong 104 and/or to the lifting frame 132.

It will be appreciated that the precise details of the four-bar linkage may be implemented in a variety of ways. For example, a driver 1109 (FIG. 10) may be provided for each pair of arms 1106A,B, 1108A,B. Further, the arms 1106A,B, 1108A,B may each include a gear 1114, 1116, 1118, 1119. The driver 1109 may include a rack or another type of mechanical linkage that is capable of engaging the corresponding gears 1114, 1116, 1118, 1119, such that the driver or drivers cause the corresponding gears 1114, 1116, 1118, 1119 to rotate, and thereby pivot the arms 1106A,B, 1108A,B relative to one another.

The lifting assembly 1102 may also include one or more cross-members 1120, which may extend between the pairs of arms 1106A,B, 1108A,B and may be provided to increase a stiffness of the lifting assembly 1102.

Figure 11:
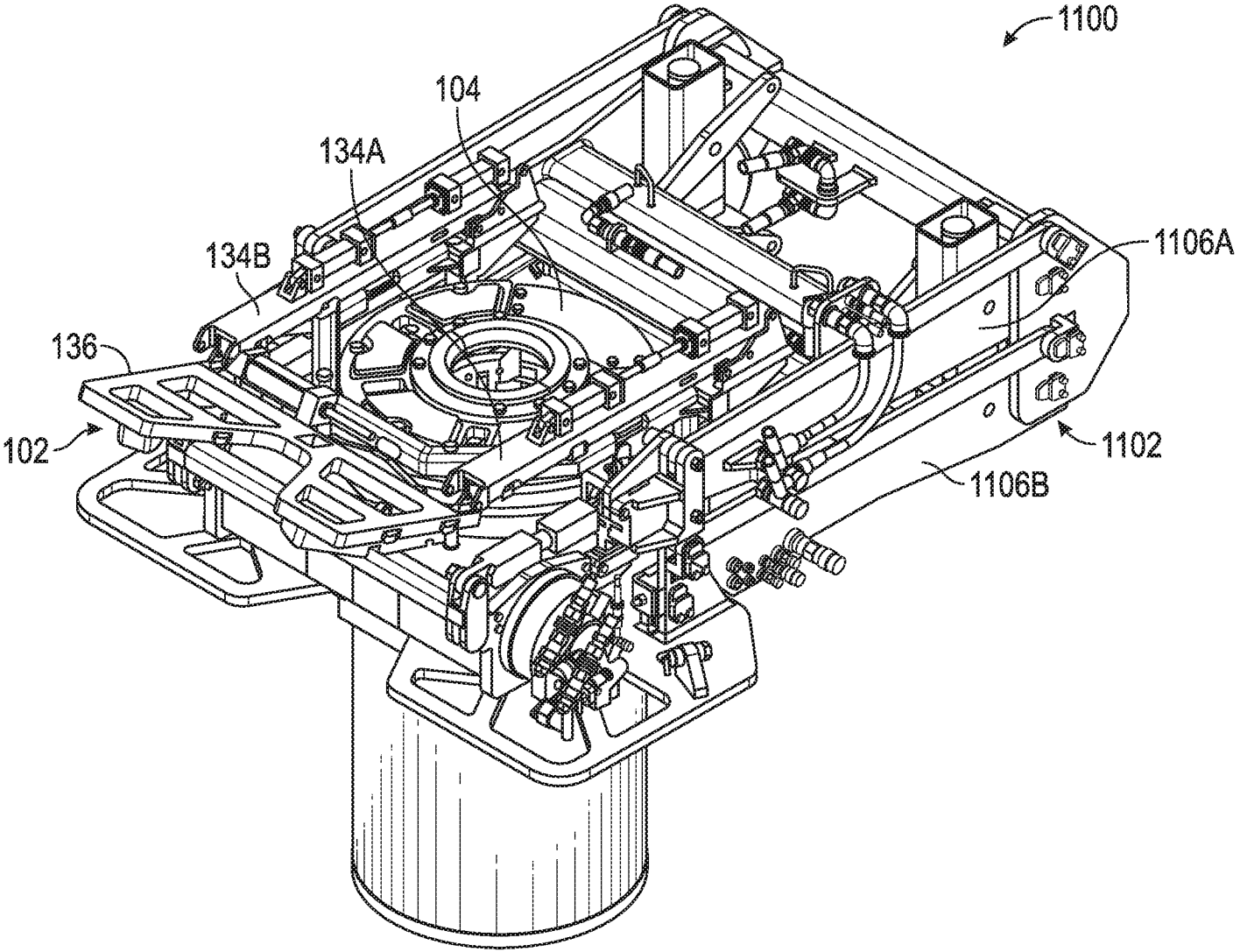
FIG. 11 illustrates a perspective view of the second tubular handling system in a collapsed configuration, according to an embodiment.

FIG. 11 illustrates a perspective view of the lifting assembly 1102 in a collapsed configuration, according to an embodiment. As shown, the lifting arms 1106A, 1106B have been pivoted together, such that they extend generally parallel to one another. Further, the arms 134A, 134B of the boxing device 102 may be pivoted towards the base 137. Additionally, the upper frame 136 may be pivoted away from the power tong 104, so as to avoid obstructing access to the center of the power tong 104. The lifting system 100 may have a similar collapsed configuration, as described above.

In this configuration, the boxing device 102, power tong 104, and lifting assembly 1102 are immediately adjacent to one another, providing a reduced vertical profile as compared to the extended position previously discussed. The collapsed configuration may be employed after tubulars are made up together, so as to reduce the obstruction that the system 1100 presents to the vertical range of motion of the tubular handling equipment (e.g., elevators, top drives, etc.), allowing such equipment to be lowered as close as possible to the spider 108 at the rig floor.

Figure 12:
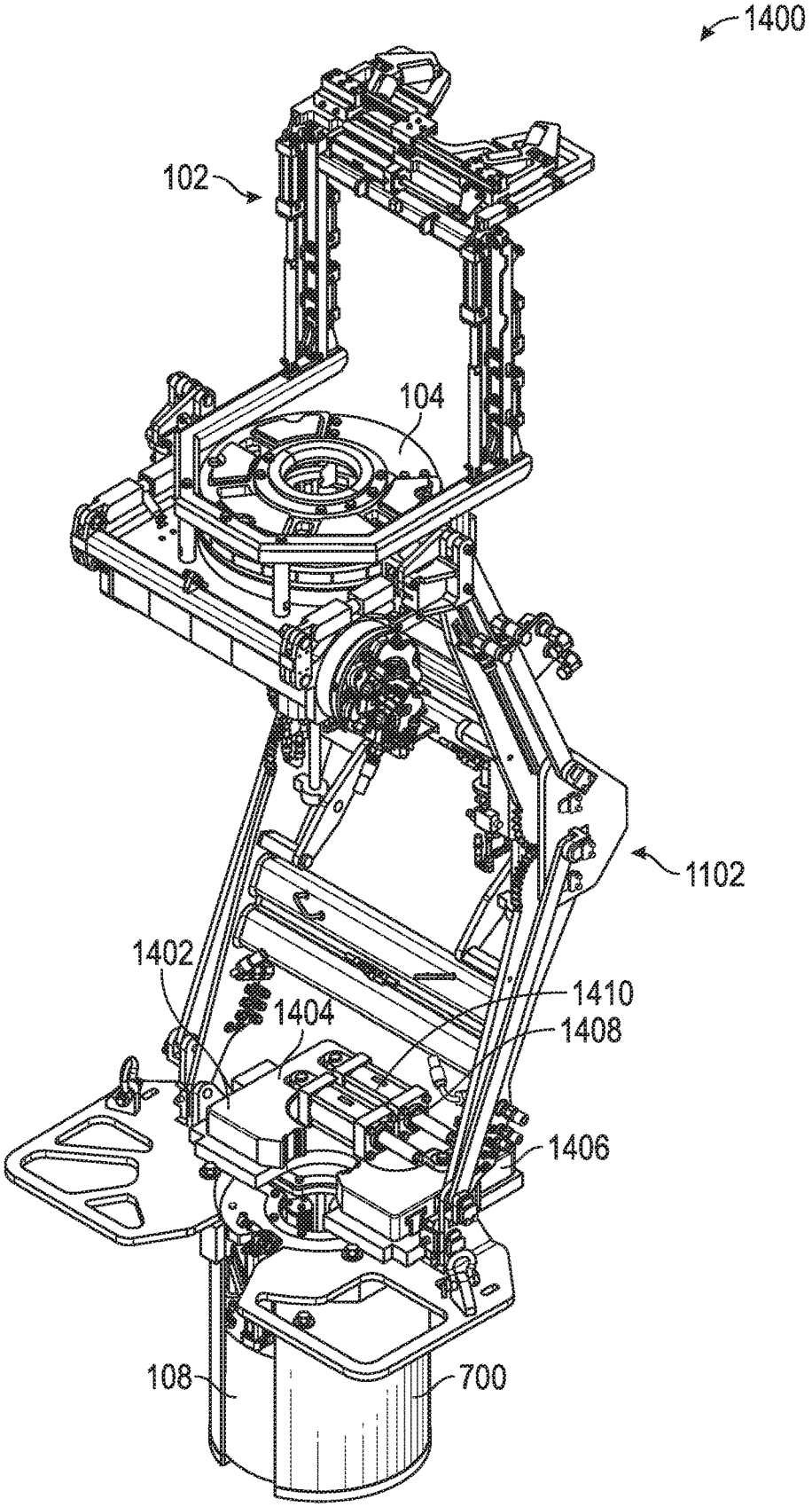
FIG. 12 illustrates a perspective view of a third tubular handling system, according to an embodiment.

FIG. 12 illustrates a perspective view of a third tubular handling system 1400, according to an embodiment. In this embodiment, the spider 108 may not be configured to transmit torque ("reactive torque") to a tubular held therein. In such embodiments, a "backup" tong 1402 may be provided for facilitating safe torque transmission. The backup tong 1402 may be positioned near or at the rig floor and positioned above, e.g., immediately above, the spider 108 (located in the can 700 as described above). The backup tong 1402 may be connected to the lifting assembly 1102, such that torque is transmitted through the power tong 104, the lifting assembly 1102, and the backup tong 1402 to a tubular engaged by the backup tong 1402.

In a specific embodiment, the backup tong 1402 may include gripping members 1404, 1406, which may be movable toward and away from each other via one or more actuators 1408, 1410. The actuators 1408, 1410 may be hydraulic actuators. Further, the gripping members 1404, 1406 may have teeth, wickers, buttons, grit, high-friction material, etc. on an inner radial surface thereof, which may be configured to bite into or otherwise engage a tubular received through the power tong 104 and the spider 108. The backup tong 1402 may thus be configured to transmit torque applied to the lifting assembly 1102 by the action of the power tong 104 and safely transmit the torque to the rig floor.

Figure 13:
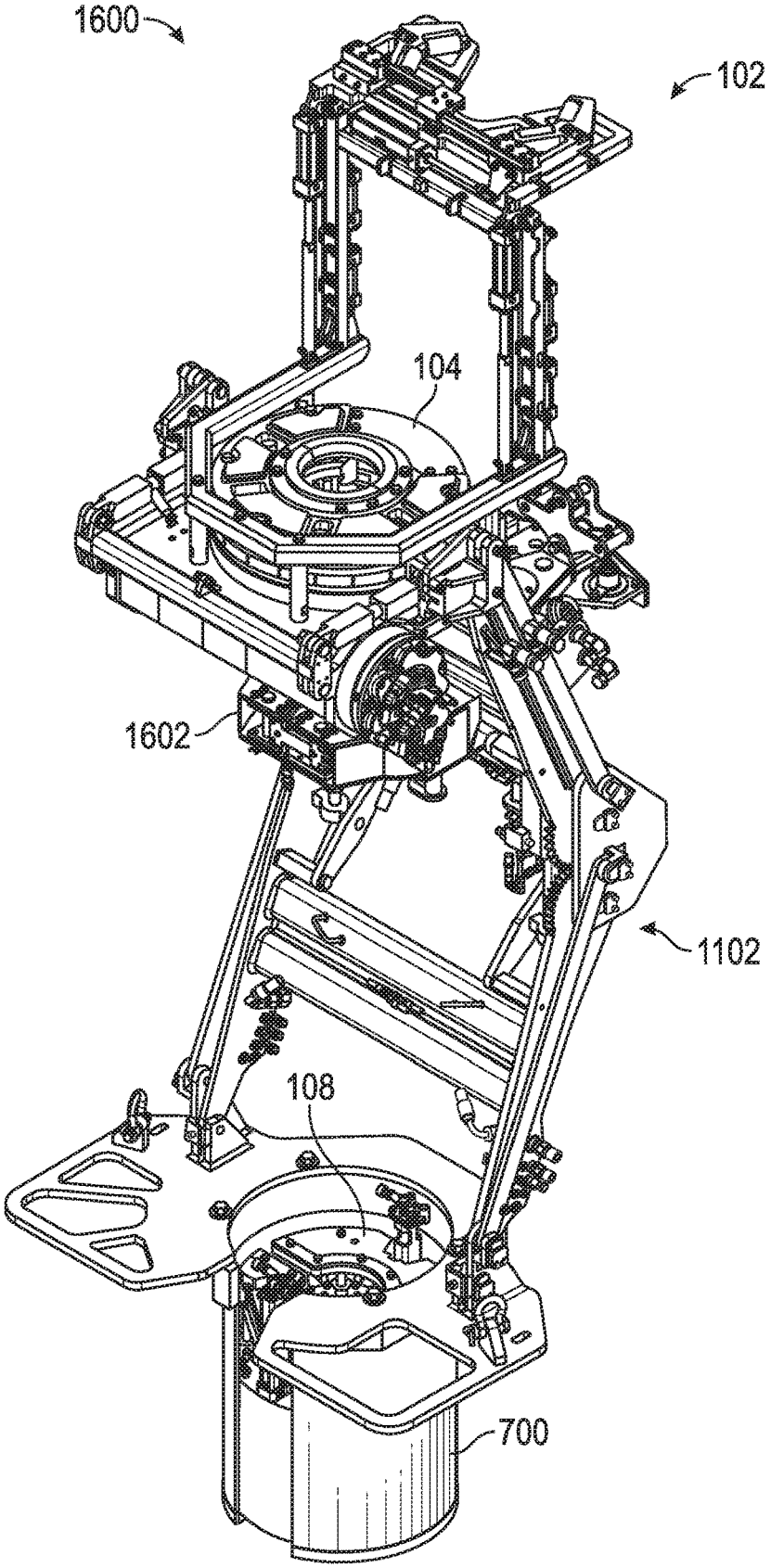
FIG. 13 illustrates a perspective view of a fourth tubular handling system, according to an embodiment.
Figure 14:
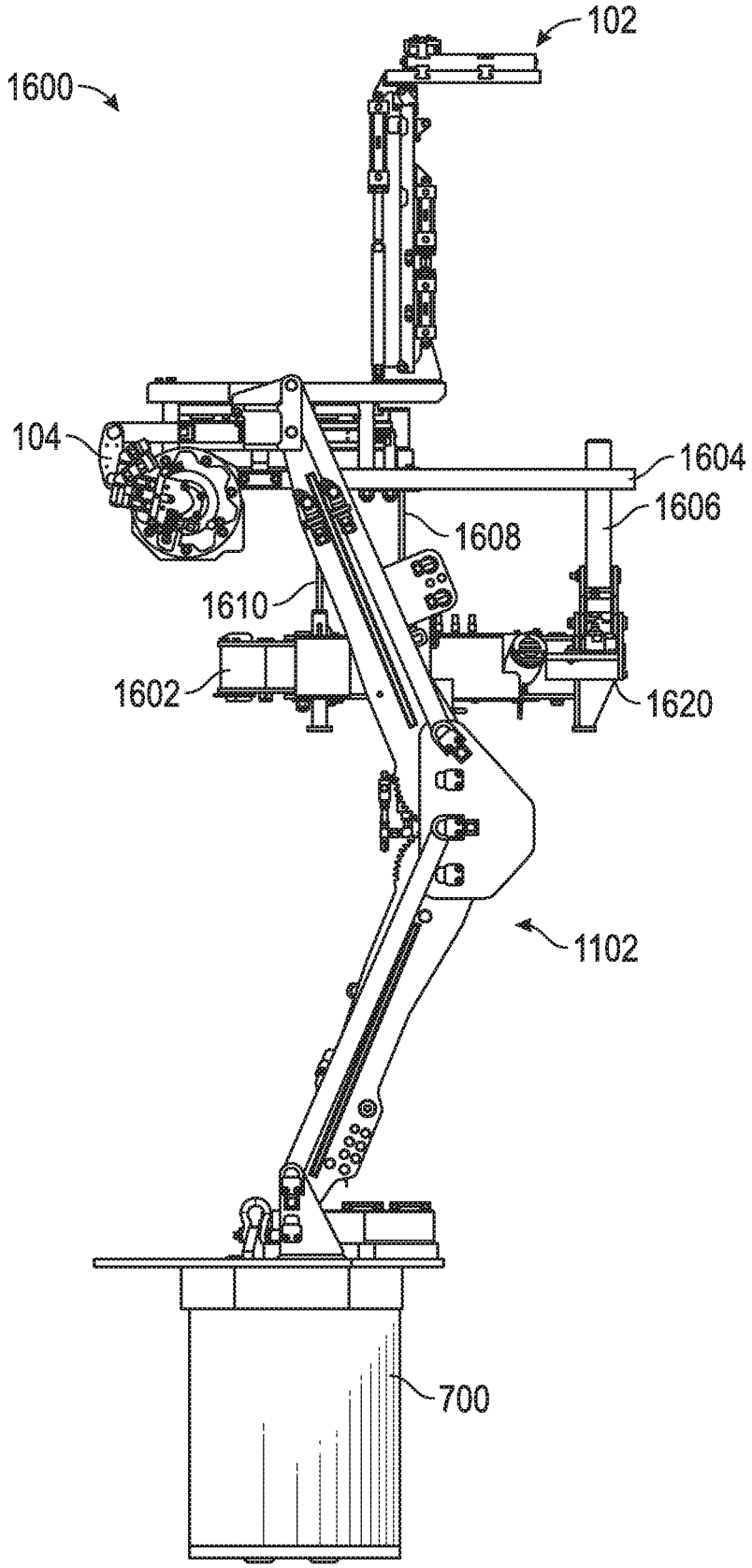
FIG. 14 illustrates a side view of the fourth tubular handling system, according to an embodiment.

FIG. 13 illustrates a perspective view of a fourth tubular handling system 1600, according to an embodiment. FIG. 14 illustrates a side view of the fourth tubular handling system 1600, according to an embodiment. Referring to FIGS. 13 and 14, the tubular handling system 1600 may include a backup tong 1602, which may be elevated from the spider 108 in the can 700, at least when the tubular handling system 1600 is in the illustrated extended position. For example, the backup tong 1602 may be elevated along with the power tong 104, by movement of the lifting assembly 1102, during operation. The backup tong 1602 may serve a similar purpose as the aforementioned backup tong. In addition, the placement and configuration of the backup tong 1602 may prevent all or some torque from being transferred through the lifting assembly 1102, such that torque is transferred directly from the power tong 104 to the backup tong 1602 and to the tubular engaged thereby.

Generally, the backup tong 1602 may be positioned sufficiently vertically below the power tong 104 that the power tong 104 may be positionable to engage one tubular, while the backup tong 1602 may be configured to engage another tubular. For example, the backup tong 1602 may engage the stump held in the spider 108, while the power tong 104 engages a new, add-on tubular to be made up to the stump.

In a specific embodiment, the backup tong 1602 may include a torque-reaction frame 1604, which may be connected to the power tong 104, the lifting frame 132, or both. Further, the backup tong 1602 may be suspended from the power tong 104, the lifting frame 132, or both by any number of supporting members, such as cables 1608, 1610. The cables 1608, 1610 may permit the lifting assembly to collapse until the power tong 104 approaches the top of the backup tong 1602.

The system 1600 may also include a torque-reaction post 1606 and a torque-reaction mechanism 1620, which cooperate with the torque-reaction frame 1604 to receive and measure torque applied to the tubular connection being made up. Accordingly, in this embodiment, the torque-measuring device may be provided in the form of the torque-reaction mechanism 1620.

Figure 15A:
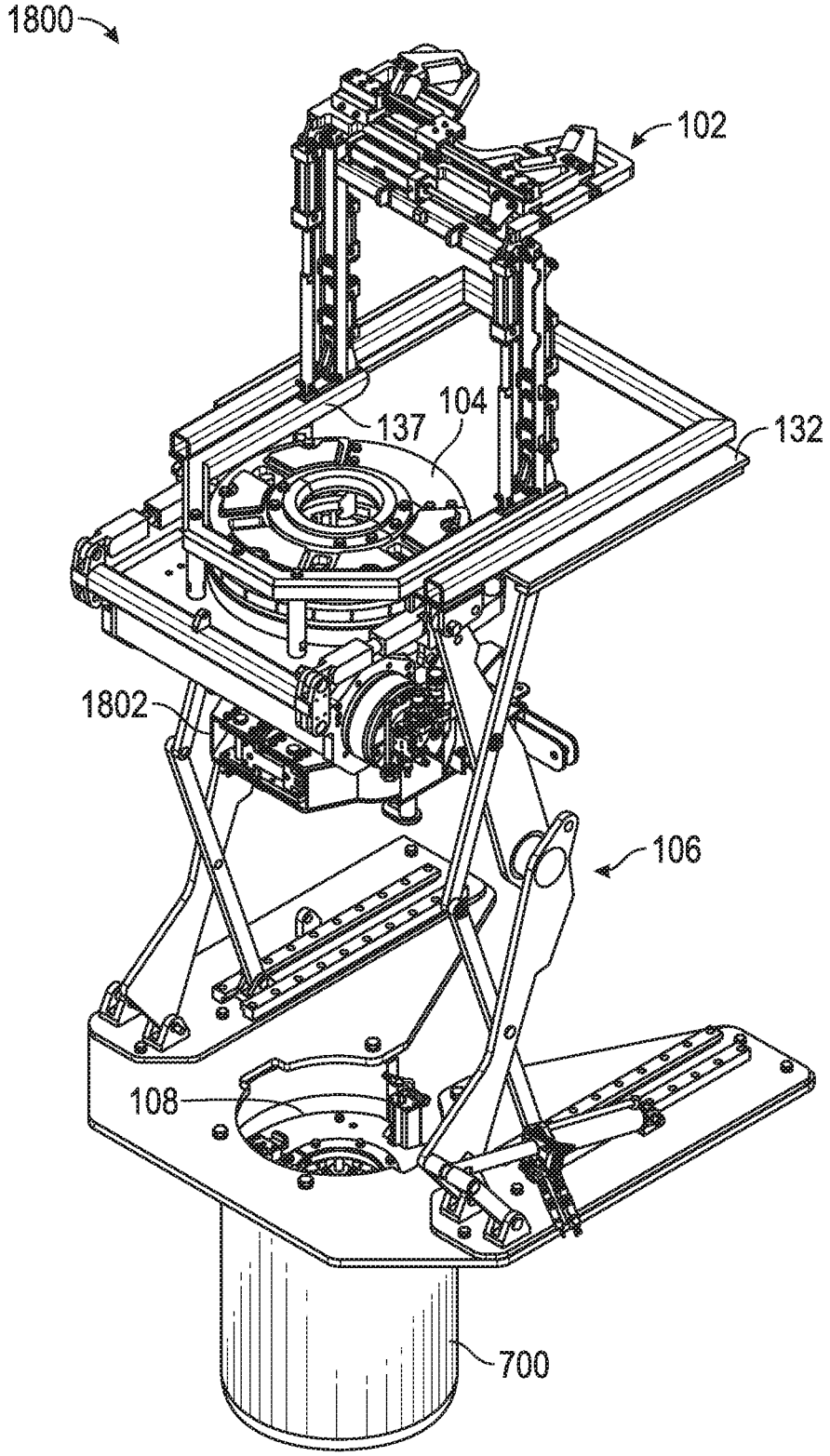
FIG. 15A illustrates a perspective view of a fifth tubular handling system, according to an embodiment.
Figure 15B:
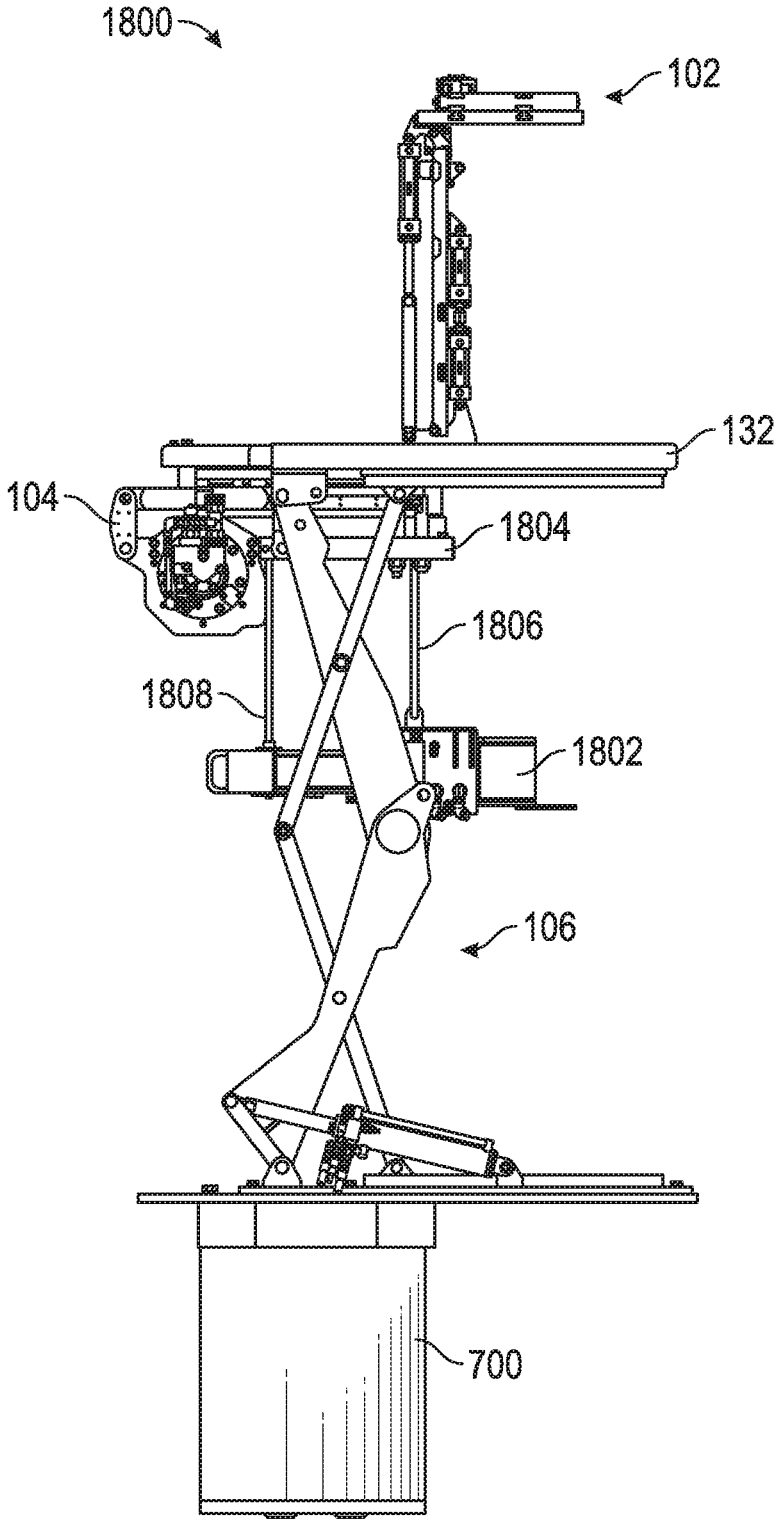
FIG. 15B illustrates a side view of the fifth tubular handling system, according to an embodiment.

FIG. 15A illustrates a perspective view of another tubular handling system 1800, according to an embodiment. FIG. 15B illustrates a side view of the tubular handling system 1800, according to an embodiment. As shown, the tubular handling system 1800 may include a backup tong 1802 that may be similar in structure and function to the backup tong 1602, but may be held in an elevated position with respect to the spider 108 (which is disposed within the illustrated can 700, as explained above), at least when the tubular handling system 1800 is in an extended position, as shown. For example, the backup tong 1802 may be elevated along with the power tong 104, by movement of the lifting assembly 1102, during operation. In particular, in an embodiment, the backup tong 1802 may include a frame 1804, which may be connected to the power tong 104, the lifting frame 132, or both. Further, the backup tong 1802 may be suspended from the power tong 104, the lifting frame 132, the base 137, or a combination thereof by any number of supporting members, such as cables 1806, 1808.

Figure 16:
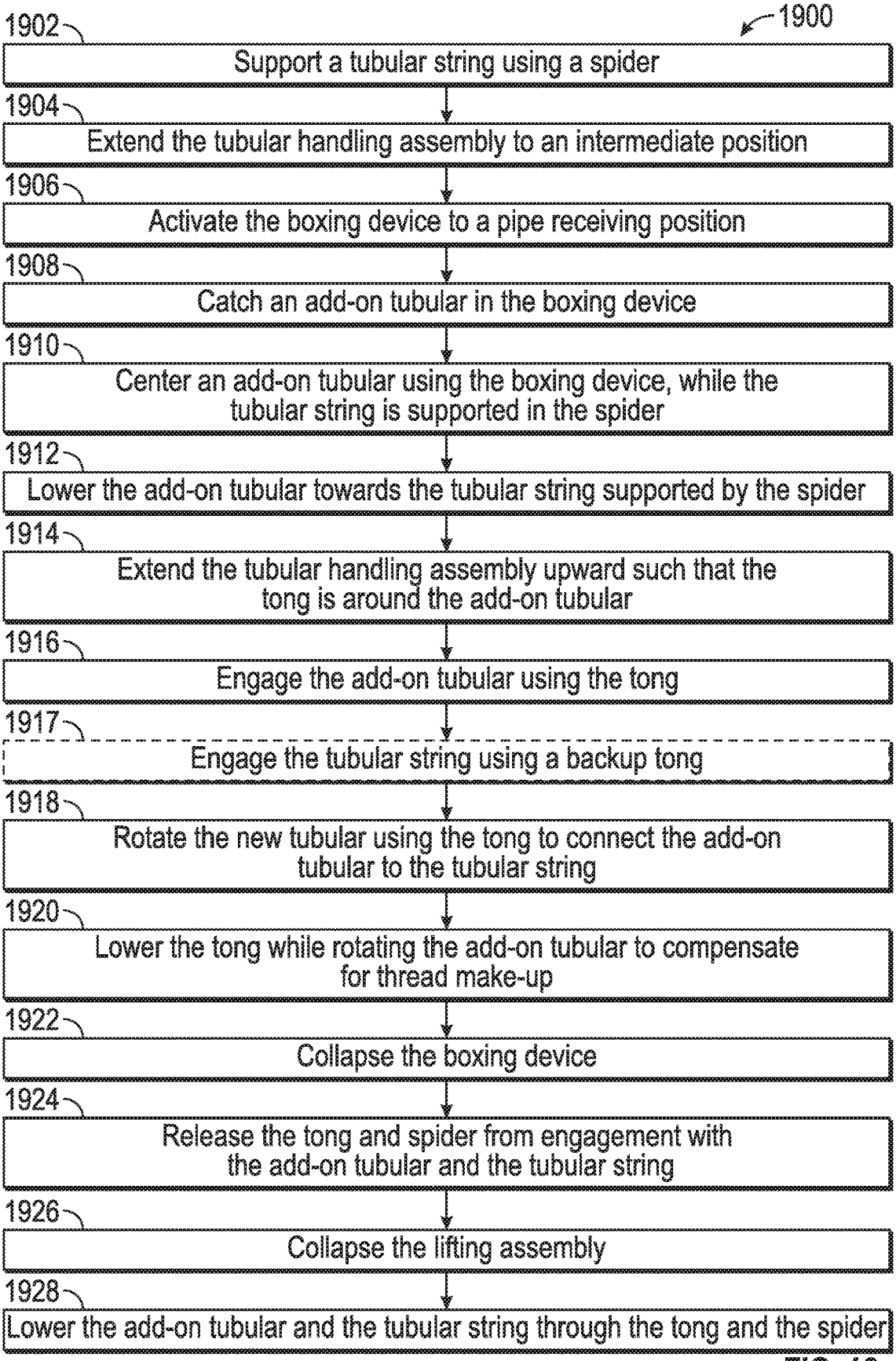
FIG. 16 illustrates a flowchart of an embodiment of a method for handling tubulars, according to an embodiment.

An example of the operation of one or more embodiments of the tubular handling systems 100, 1100, 1400, 1600, and 1800 will now be described. In particular, FIG. 16 illustrates a flowchart of an embodiment of a method 1900 for such tubular handling operation, which will be described with reference to FIGS. 17A-17F, showing stages of the operation/method. Further, the tubular handling system 1100 is used for illustrative purposes in these figures, but it will be readily apparent that the method 1900 may be employed and/or tailored for use with any of the tubular handling assemblies discussed above and/or others.

Figure 17A:
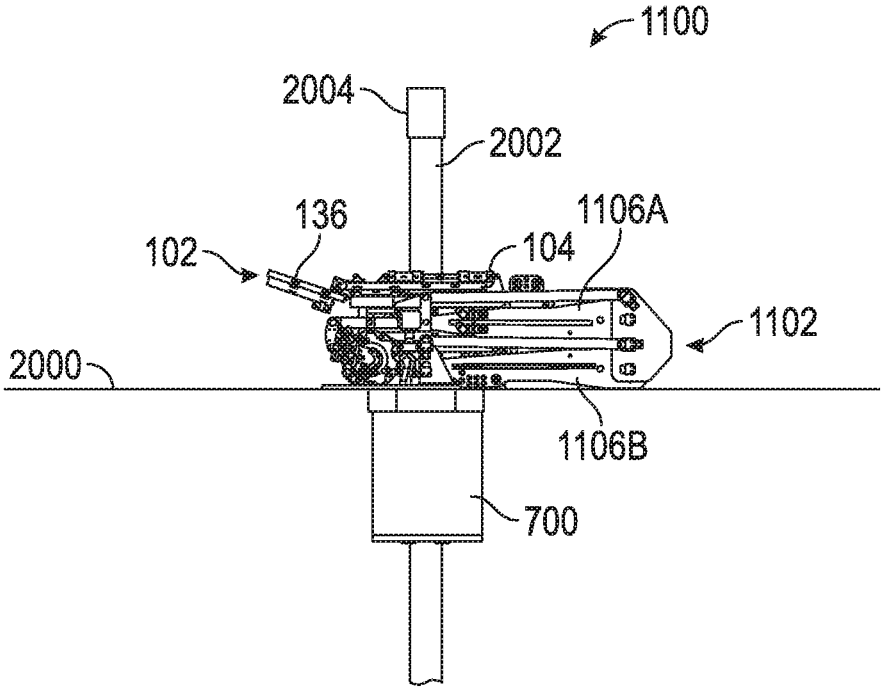
FIGS. 17A, 17B, 17C, 17D, 17E, and 17F illustrate views of an example of a tubular handling system during various stages of the method of FIG. 16, according to an embodiment.

The method 1900 may begin by supporting a tubular string 2002 using a spider 108 near the rig floor 2000, as at 1902. This is illustrated in FIG. 17A. The tubular string 2002 may include one or more joints of tubulars, such as casing, which may extend into a well. The spider 108 may or may not be able to transmit torque to the tubular string 2002, as described above. At this stage, the tubular handling system 1100 may be in its collapsed configuration, as shown. For example, the arms 1106A, 1106B are positioned such that they are generally parallel to one another, providing a low vertical profile for the lifting assembly 1102. This may result in the power tong 104 being relatively close to the spider 108 (in the can 700). Further, the boxing device 102 is in a retracted position, and the upper frame 136 pivoted away from the power tong 104 and a tubular string 2002 received through the power tong 104 and the spider 108. The spider 108 may support the vertical load (weight) of the tubular string 2002 and any structures (tubulars, tools, etc.) coupled thereto as part of a tubular string. In this position, a portion of the tubular string 2002 extends upwards from the power tong 104, and may terminate with an upper connection 2004. The upper connection 2004 may be a "threaded box" end of the tubular string 2002, configured to receive and couple to a threaded pin end of another tubular, in a process generally referred to as "make-up".

Figure 17B:
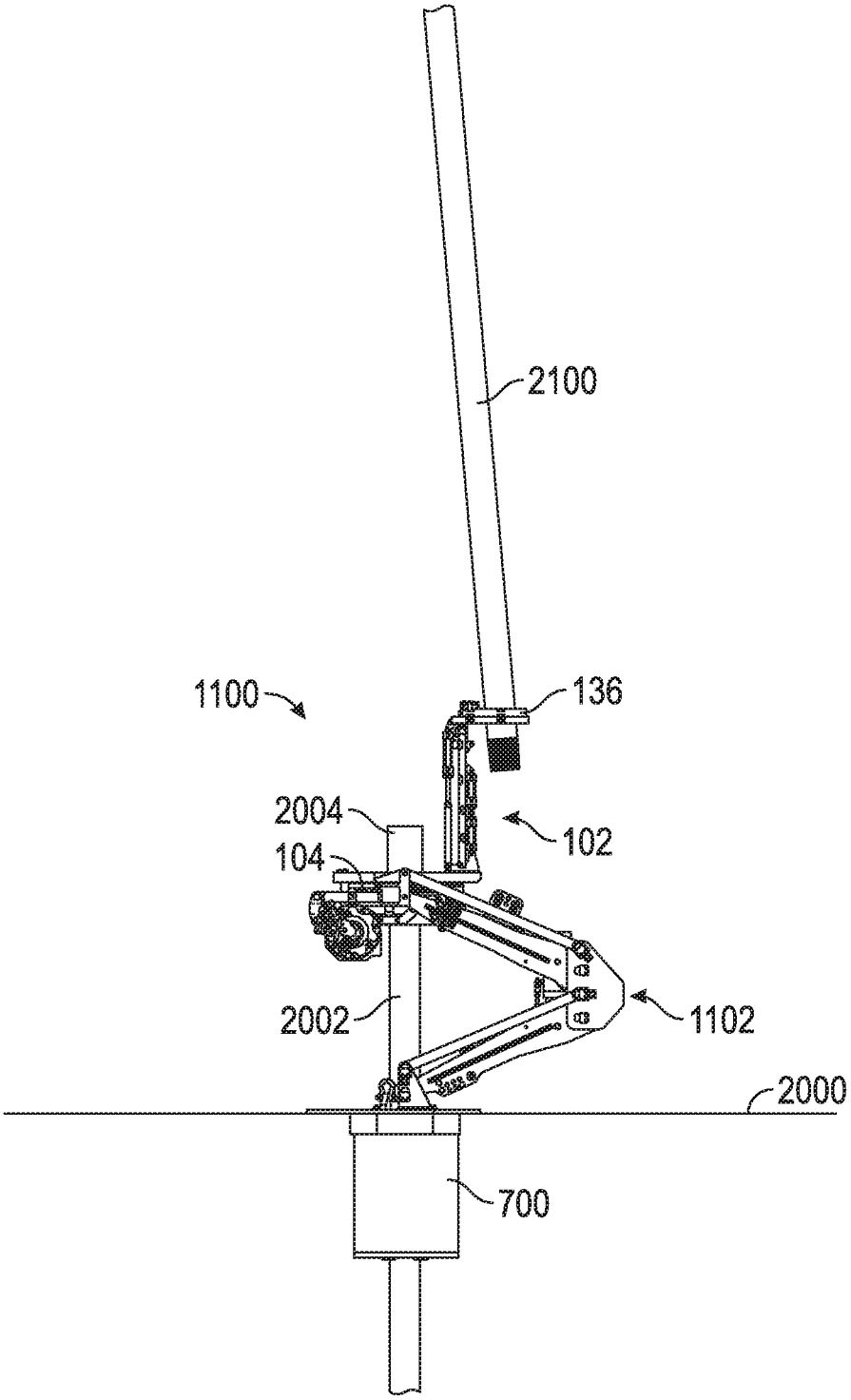

When it becomes desirable to add a new tubular to an upper connection 2004 of the tubular string 2002, the method 1900 may proceed to extending the tubular handling system 1100 to an intermediate position, as at 1904. This is shown in FIG. 17B. For example, as shown, the lifting assembly 1102 may be partially expanded to a configuration between fully-expanded and fully-collapsed. In this intermediate position, the power tong 104 may be around the tubular string 2002, below the upper connection 2004. Further, the boxing device 102 may be actuated to a pipe-receiving position, as at 1906, as shown, with the upper frame 136 pivoted to catch an add-on tubular 2100, as at 1908. In some embodiments, the grippers 146A, 146B (see, e.g., FIG. 1) may be actuated to complete the catching of the add-on tubular 2100 in the recess 139 of the frame 136.

Figure 17C:
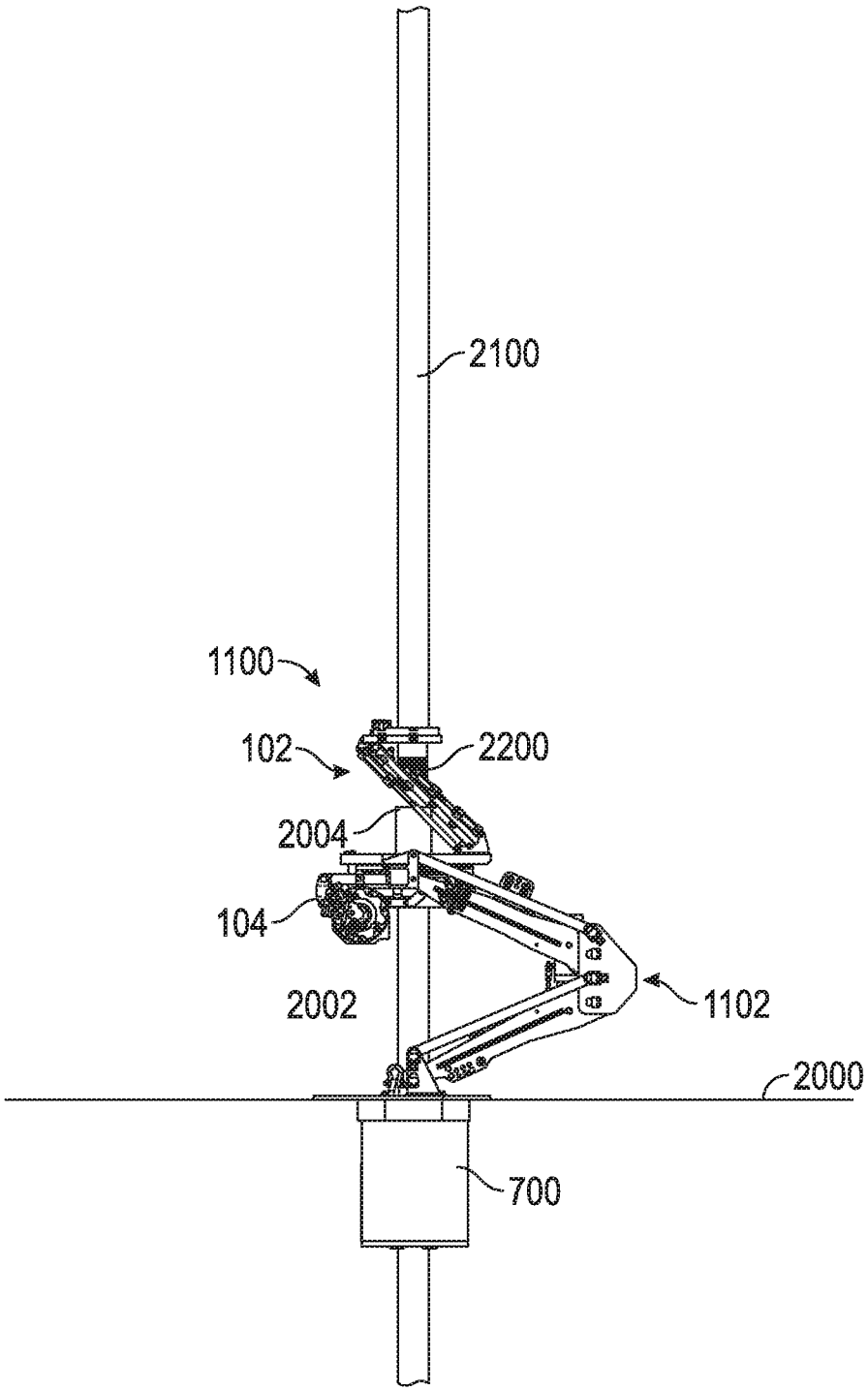

Referring now to FIG. 17C, the boxing device 102 may be employed to facilitate centering the add-on tubular 2100 above well center, as at 1910. In an embodiment, the arms 134A, 134B of the boxing device 102 may be pivoted into an intermediate position, between fully-collapsed and fully-expanded, which may result in a lower connection 2200 of the add-on tubular 2100 being above and generally (e.g., within an acceptable tolerance of) coaxial with the upper connection 2004 of the tubular string 2002.

Figure 17D:
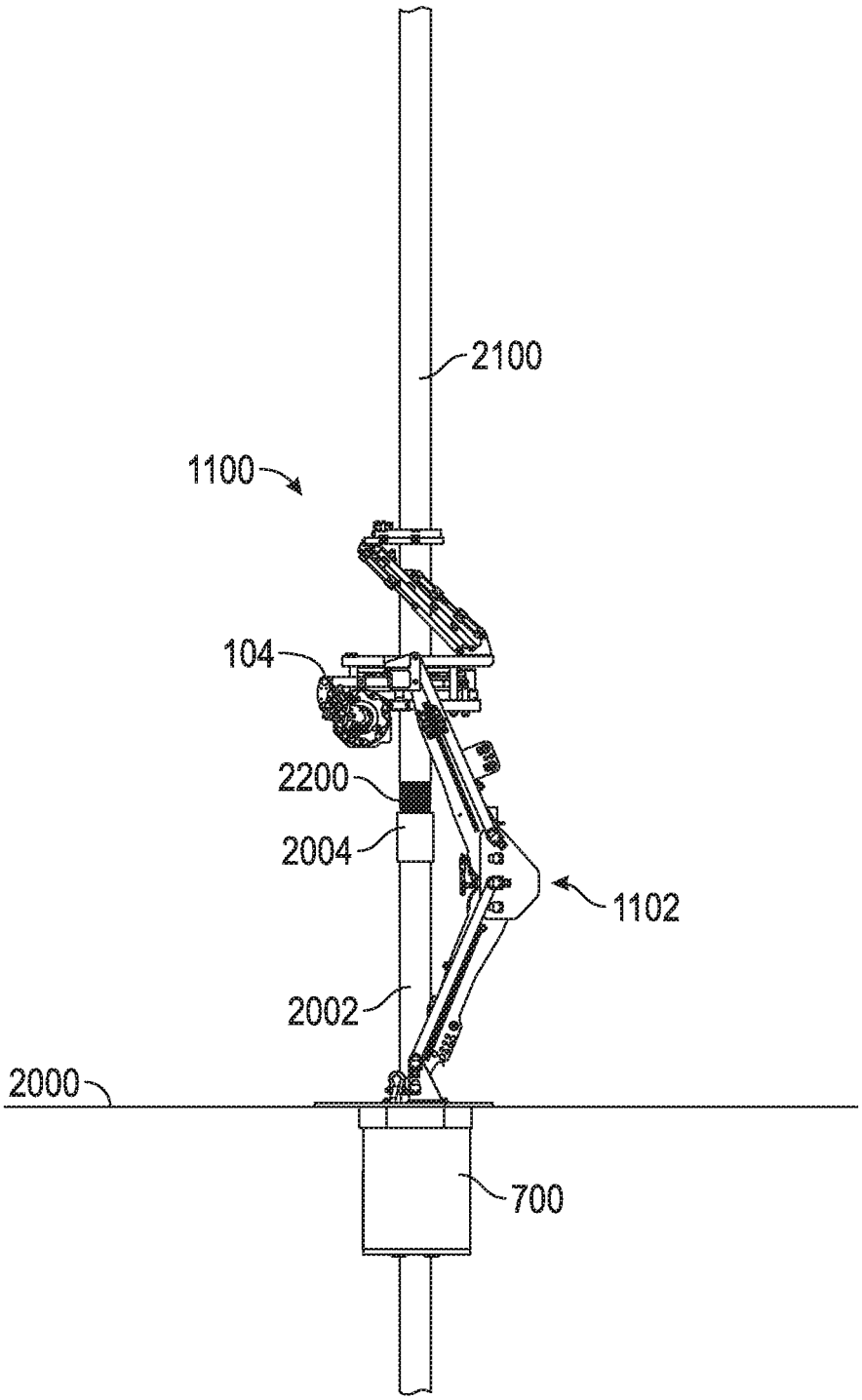

Next, as at 1912 and shown in FIG. 17D, the add-on tubular 2100 may be lowered toward the tubular string 2002 held by the spider 108, such that the lower connection 2200 of the add-on tubular 2100 engages or is positioned closely proximal to the upper connection 2004 of the tubular string 2002. For example, in this position, rotation of the add-on tubular 2100 relative to the tubular string 2002 may cause threads of the upper and lower connections 2004, 2200 to engage and thereby connect the tubular string 2002 and the add-on tubular 2100.

Further, as at 1914, the lifting assembly 1102 may be extended upward (e.g., away from the rig floor 2000) to an extended position, which may or may not be the full extent of the range of motion of the lifting assembly 1102, depending on the configuration. As the lifting assembly 1102 is moved, the power tong 104 may slide axially past the upper connection 2004, without the power tong 104 being laterally removed from the tubular string 2002. Eventually, as shown, the power tong 104 becomes positioned around the tubular 2100, e.g. above the threaded region of the lower connection 2200.

The power tong 104 may then engage the add-on tubular 2100, as described above, as at 1916, and apply torque thereto, to rotate the add-on tubular 2100, as at 1918. The reactionary torque in the power tong 104 may be transmitted to the tubular string 2002 via the lifting assembly 1102 and the spider 108, in one embodiment. In some embodiments, a backup tong (as described above) may engage the tubular string 2002, as indicated at 1917, and may be employed in addition to or instead of a spider 108 to transmit such torque to the tubular string 2002.

Rotation of the add-on tubular 2100 may proceed by rotating the rotatable section 200 of the power tong 104 until the jaws 500A-C (FIG. 4) thereof engage the add-on tubular 2100. The rotation of the power tong 104 may continue until a predetermined amount of torque is applied to the add-on tubular 2100, indicating connection is complete. Further, the engagement between the jaws 500A-C and the tubular 2100 may thus serve to center the power tong 104 on the add-on tubular 2100 and thus on the well.

As the power tong 104 applies torque to the add-on tubular 2100, the add-on tubular 2100 rotates relative to the tubular string 2002, resulting in engagement therebetween, as noted above. Further, such rotation and engagement results in the add-on tubular 2100 moving downwards as the threads of the upper connection 2200 are progressively received into the lower connection 2004. The lifting assembly 1102 may thus collapse slightly, moving the power tong 104 downwards, during the connection process, as at 1920. This is referred to as "thread compensation."

Figure 17E:
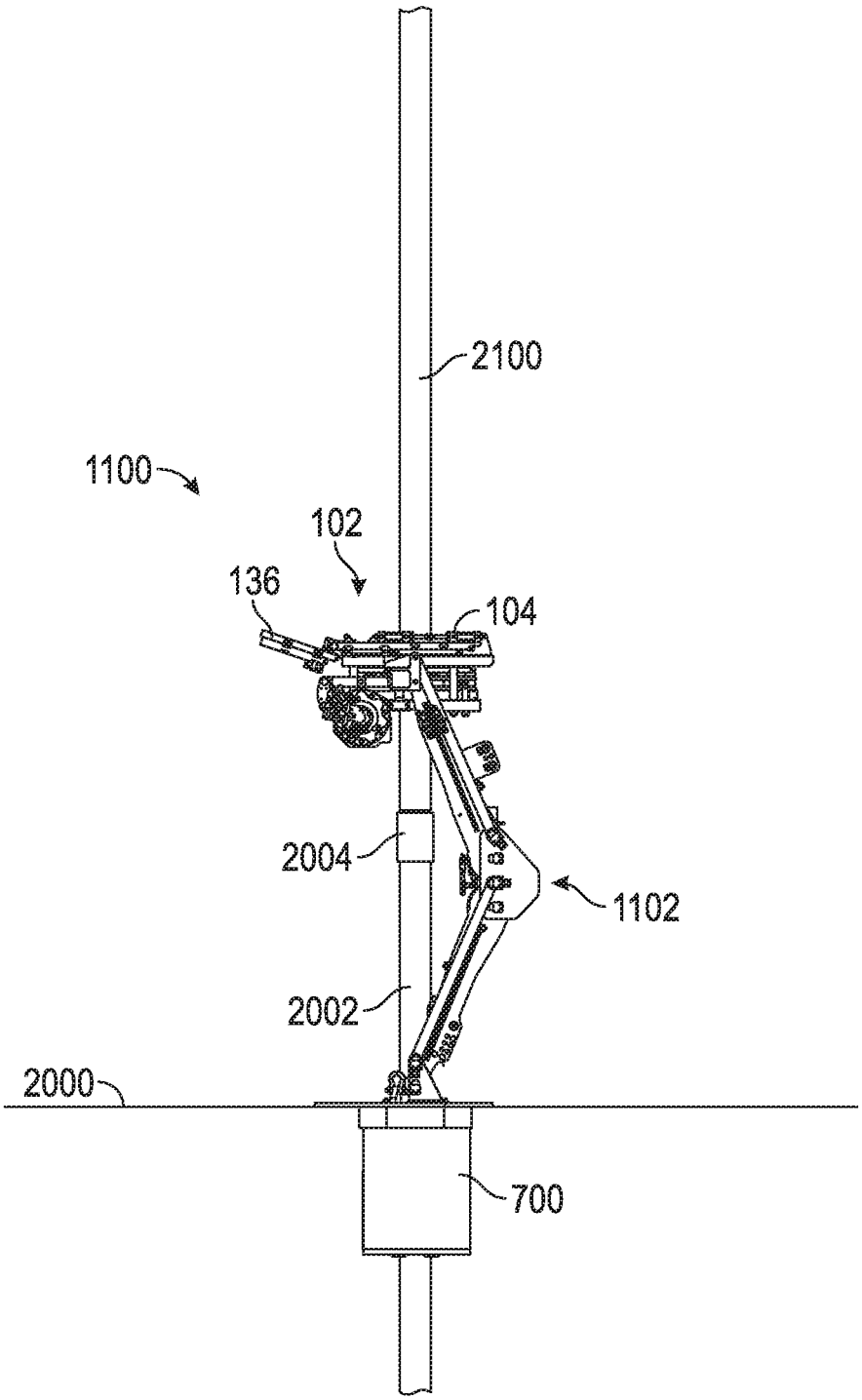

Referring to FIG. 17E, as shown, the add-on tubular 2100 has been fully connected to the tubular string 2002. At some point during the connection process, as at 1922, the boxing device 102 may be collapsed and the frame 136 pivoted away from the add-on tubular 2100. This may take place before, during, or after the power tong 104 rotates the add-on tubular 2100. In this configuration, with the add-on tubular 2100 fully connected to the tubular string 2002, an elevator may engage the add-on tubular 2100, and support the tubular string 2002 via connection with the add-on tubular 2100. Thus, the power tong 104 (and backup tong, if provided) and the spider 108 may release the add-on tubular 2100 and the tubular string 2002, respectively, as at 1924.

Figure 17F:
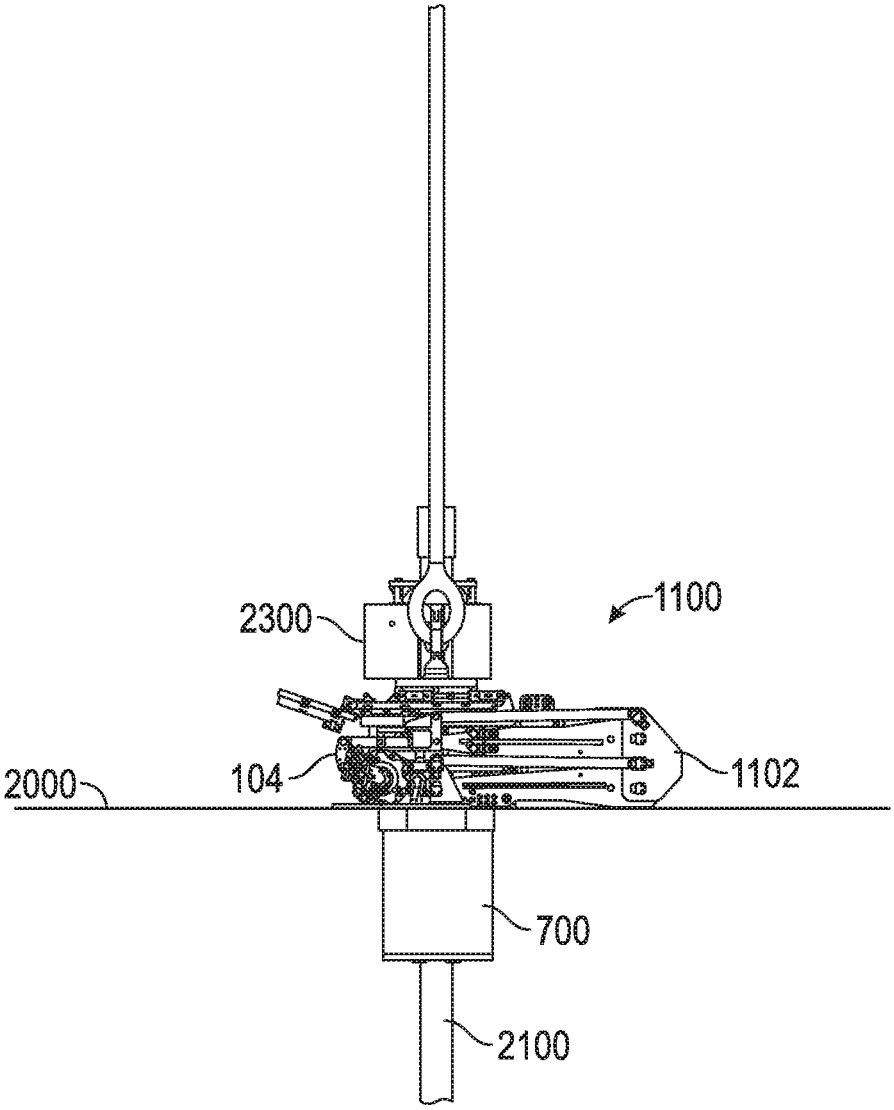

As shown in FIG. 17F, the tubular handling system 1100 may be collapsed, as at 1926. In some embodiments, this may occur after the power tong 104 releases from engagement with the add-on tubular 2100. In other embodiments, the tubular handling system 1100 may be collapsed as the add-on tubular 2100 is lowered through the spider 108, as at 1928. Once the elevator 2300 reaches the lower range of its movement, e.g., adjacent to, in contact, or spaced apart from the power tong 104, the spider 108 may engage the tubular 2100, the elevator 2300 may release the add-on tubular 2100, and the elevator 2300 may be moved upward (e.g., away from the add-on tubular 2100 and/or rig floor 2000). The next add-on tubular may then be loaded into position using the process and equipment discussed above.

Figure 18:
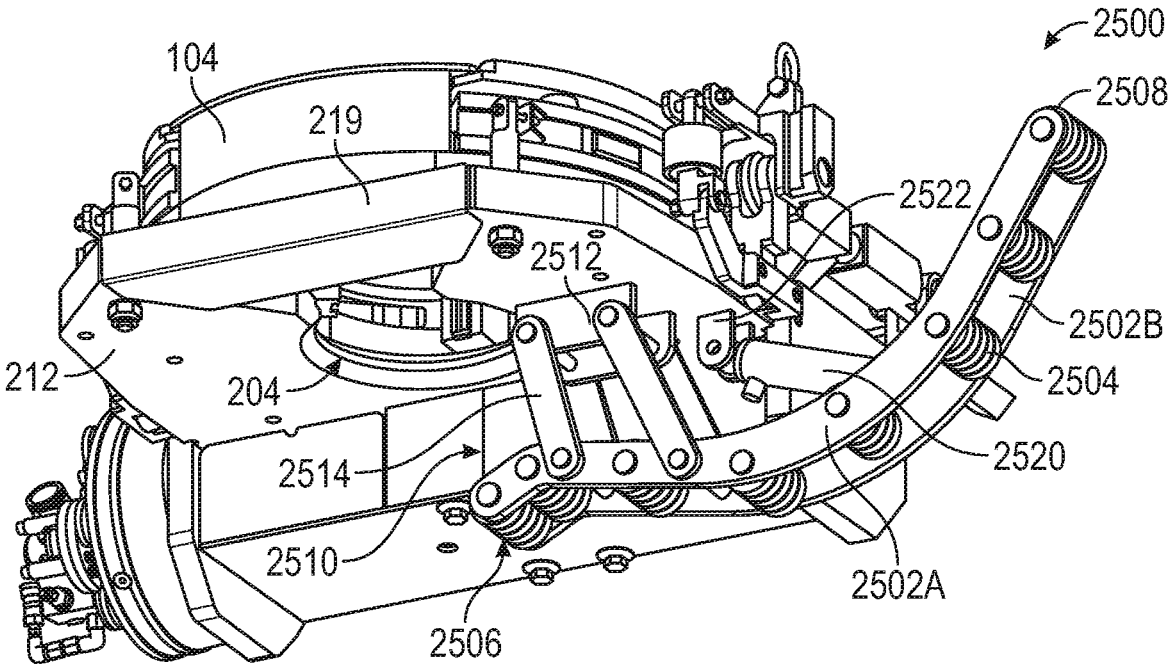
FIG. 18 illustrates a perspective view of an underside of a power tong of the tubular handling system with a control line guide connected thereto, according to an embodiment.

FIG. 18 illustrates a perspective view of an underside of the tong 104, according to an embodiment. In particular, in this embodiment of the tong 104, a control line guide 2500 is connected thereto. The control line guide 2500 may be coupled to the underside of the tong 104, e.g., to the body 212. The control line guide 2500 may include a pair of guide rails 2502A, 2502B, which may be parallel to one another, with rollers 2504 positioned therebetween. The rollers 2504 may be supported on pins or axles, allowing the rollers 2504 to rotate relative to the rails 2502, but in other embodiments, may be stationary.

The rails 2502A, 2502B may further define a proximal end 2506 and a distal end 2508 of the control line guide 2500. The proximal end 2506 may be closest to the opening 204 of the tong 104, while the distal end 2508 may be farthest away from the opening 204. The rails 2502A, 2502B may further define a curved profile, which may include one or more curves. For example, the rails 2502 may include a main curve, which may extend across a majority of the length of the rails 2502A, 2502B and extend outward and upward from the tong 104, such that the control line guide 2500 is configured to smoothly receive a control line. The rails 2502A, 2502B may also define a second curve at the proximal end 2506, which may be curved, downward, opposite to the main curve, and configured to direct and support the control line downward.

The control line guide 2500 may also include a linkage assembly 2510 including a bracket 2512 connected, e.g., welded, to the body 212 of the tong 104. The linkage assembly 2510 may also include two or more legs (four shown, one indicated as 2514), which may be pivotally connected to the bracket 2512 and the respective rails 2502A, 2502B. The control line guide 2500 may also include a driver 2520, which may be an extendable hydraulic cylinder, as shown, but in other embodiments, may be a linear mechanical actuator, a gear drive, worm drive, or any other suitable driver. The driver 2520 may be configured to extend and retract the guide rails 2502 relative to the tong 104, as supported by the linkage assembly 2510. In the illustrated embodiment, the driver 2520 is pivotally connected to the body 212 at a clevis 2522.

Figure 19:
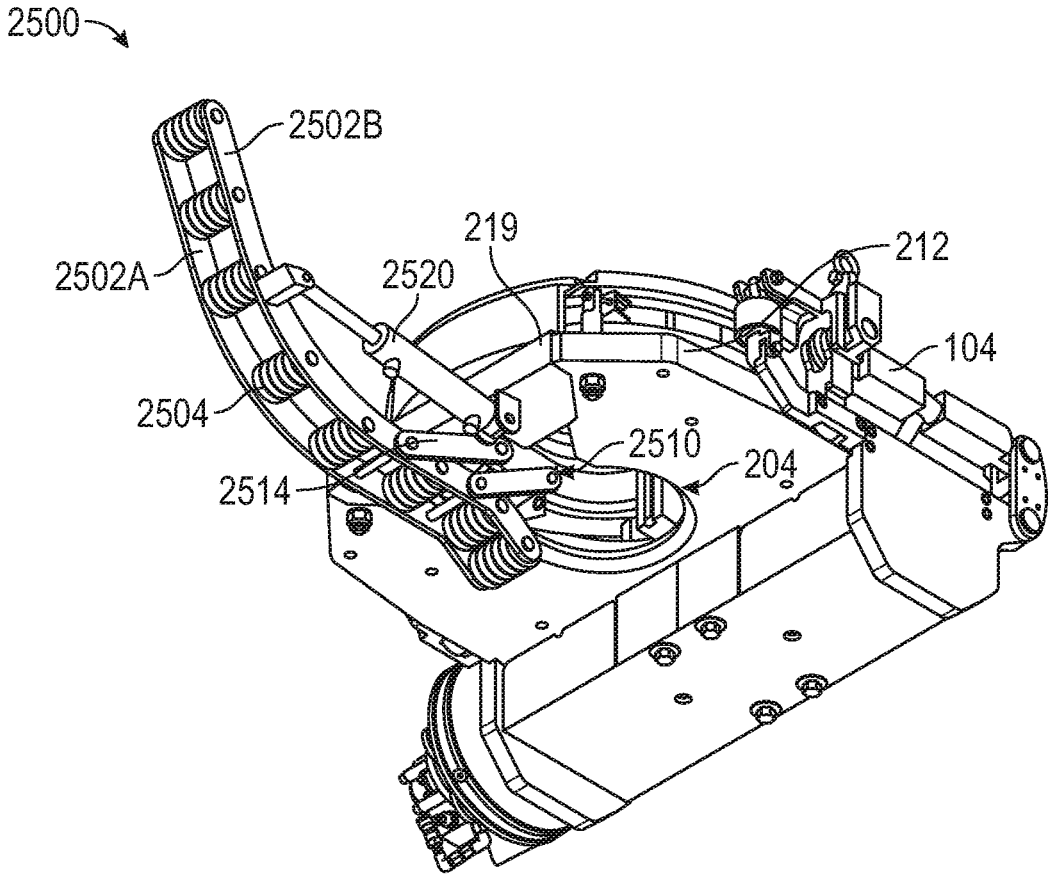
FIG. 19 illustrates a perspective view of an underside of the power tong of the tubular handling system, including the control line guide, according to another embodiment.

As shown in FIG. 18, the control line guide 2500 may extend past a side of the tong 104 that does not include the door 219, and may curve out and upward therefrom. In another embodiment, as shown in FIG. 19, the control line guide 2500 may be connected to the door 219 and may extend outward and upward therefrom. In other embodiments, the control line guide 2500 can be connected to any side of the body 212 and extend outward and upward therefrom. Accordingly, it will be appreciated that the control line guide 2500 may be positioned in any orientation that is convenient for performing the function of guiding a control line to a tubular string.

Figure 20:
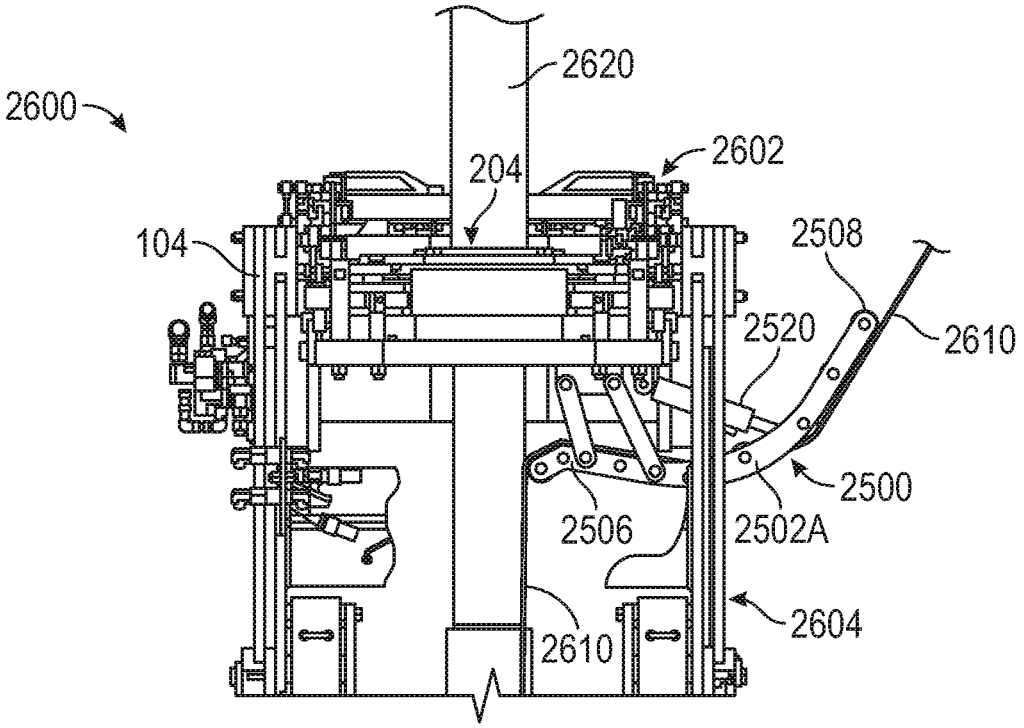
FIG. 20 illustrates a frontal, elevation view of a portion of a tubular handling system including the control line guide in an extended position, according to an embodiment.

FIG. 20 illustrates a side, elevation view of part of a tubular handling system 2600 incorporating the control line guide 2500, according to an embodiment. The tubular handling system 2600 may be provided as one or more embodiments of any of the tubular handling systems discussed herein, and thus, for example, may include a boxing device 2602 and a lifting assembly 2604, among other components as described above.

As shown, the control line guide 2500 may receive a control line 2610, which may be configured to send and receive communication and/or power signals to or from downhole tools from or to surface equipment.

Further, the control line guide 2500 may have a first or "extended" position, as shown. In the extended position, the proximal end 2506 is held in close proximity to a tubular 2620 received through the opening 204 and engaged by the tong 104. For example, in the extended position, the driver 2520 (e.g., extendable cylinder) may be retracted (or extended depending the configuration), thereby pivoting the legs 2514 and drawing the guide rails 2502A, 2502B toward the tubular 2620. Accordingly, the control line 2610 is run between the rails 2502A, 2502B, and over at least some of the rollers 2504 (see FIG. 18), before being directed downward at the proximal end 2506. In this first, extended position, the control line 2610 is brought into close proximity with the tubular 2620 to facilitate connecting the control line 2610 to the tubular 2620, as will be discussed in greater detail below.

Figure 21:
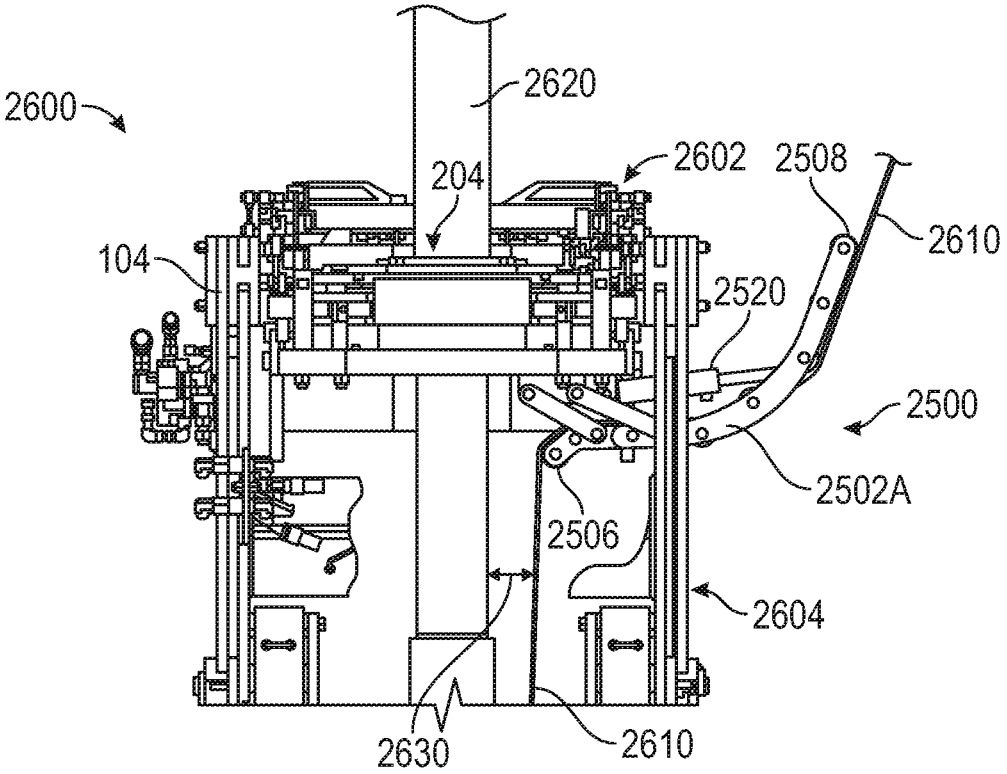
FIG. 21 illustrates a frontal, elevation view of a portion of the tubular handling system including the control line guide in a retracted configuration, according to an embodiment.

FIG. 21 illustrates the tubular handling system 2600 incorporating the control line guide 2500, with the control line guide 2500 in a second or "retracted" position, according to an embodiment. To reach this configuration from the extended position of FIG. 20, the driver 2520 is actuated, e.g., extended, thereby pulling the guide rails 2502A, 2502B, particularly the proximal end 2506, away from the opening 204 of the tongs 104. This creates a control line clearance gap 2630 laterally between the tubular 2620 and the control line 2610. The control line clearance gap 2630 may result in the control line 2610 being held at a sufficient distance from the tubular 2620 to allow the tubular to be gripped by slips without risking damage to the control line 2610, as will be described in greater detail below.

Figure 22:
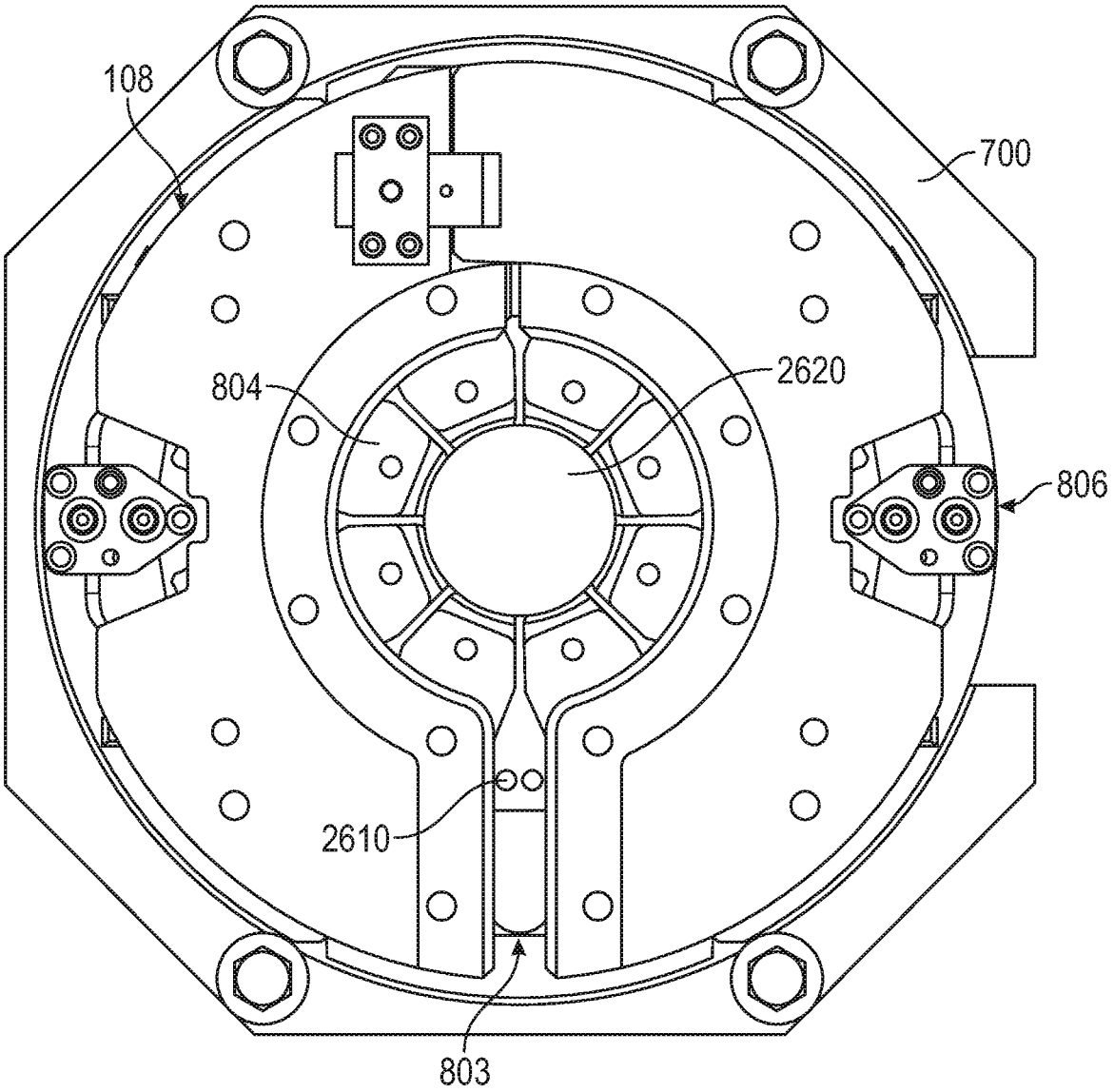
FIG. 22 illustrates a top, plan view of a spider of the tubular handling system positioned in a can of the tubular handling system, according to an embodiment.

FIG. 22 illustrates a top view of the spider 108 positioned within the can 700, with the control line 2610 proceeding therethrough, according to an embodiment. For example, as shown, the control line 2610 is received through the control-line gap 803. As a result of maintaining the control line clearance gap 2630 (see FIG. 21), the control line 2610 is held in the control-line gap 803, radially outward from the slips 804. As such, the slips 804 are free to move radially inward into contact with the tubular 2620, without risk of the control line 2610 becoming entrained between adjacent slips 804 and/or radially between the slips 804 and the tubular 2620.

Figure 23:
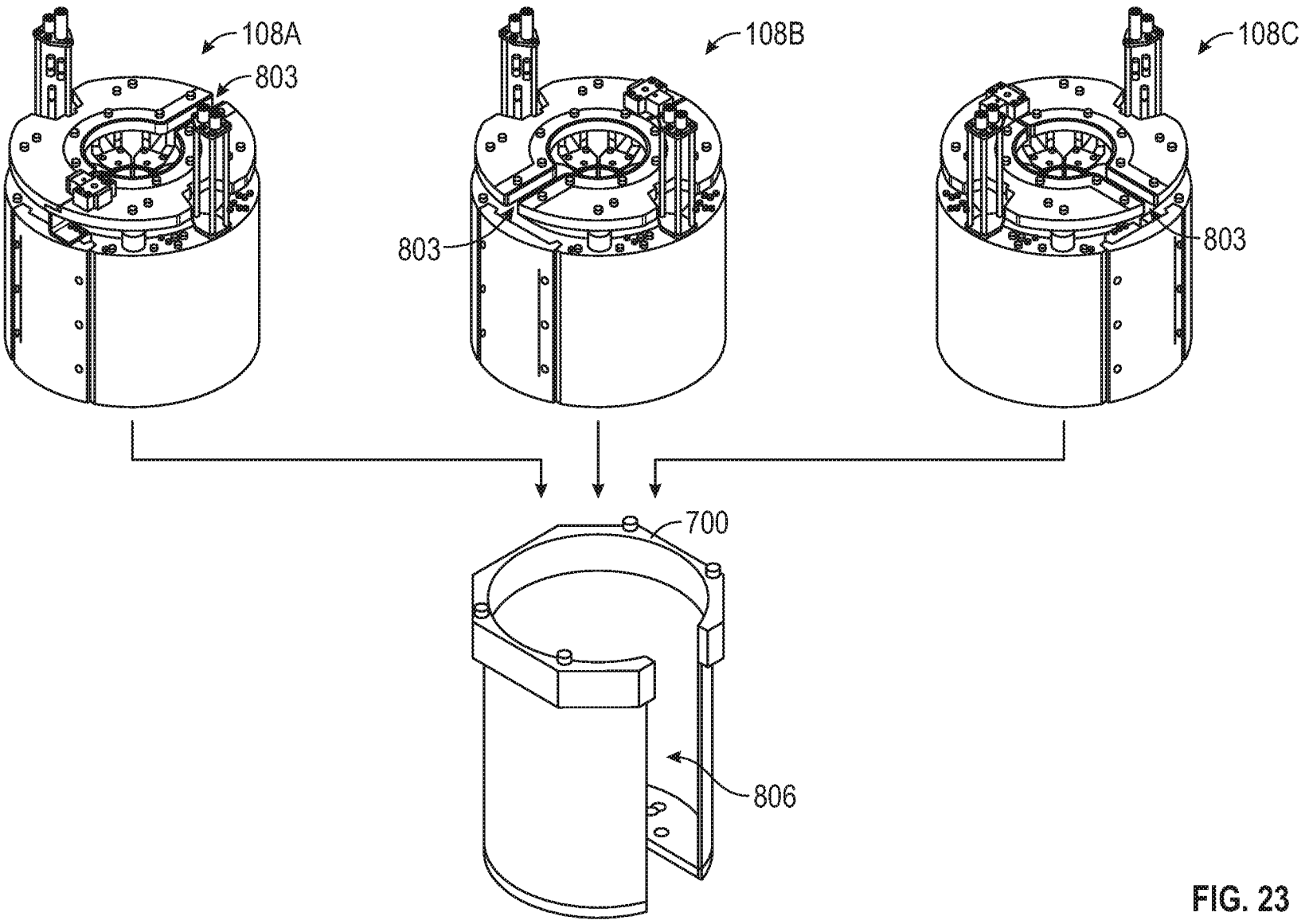
FIG. 23 illustrates a conceptual, exploded view of three different examples of orientation options for insertion of the spider of the tubular handling system into the can, according to an embodiment.

As shown in FIG. 23, it will be appreciated that the spider 108 may be oriented in any way with respect to the can 700. It will be appreciated that in a given implementation, a single spider 108 may be used, with the depiction of FIG. 23 of three spiders 108A, 108B, 108C merely being intended to illustrate three example orientations of the spider 108. Thus, for example, the spider 108A may be inserted into the can 700 such that the control-line gap 803 thereof is 90 degrees counter-clockwise from the door 806. In another example, the spider 108B may be inserted into the can 700 such that the control-line gap 803 thereof is 90 degrees clockwise from the door 806. In another example, the spider 108C may be inserted into the can 700 such that its control-line gap 803 is aligned with the door 806. In other examples, the spider 108 can be oriented such that its control-line gap 803 is offset by any angle from the door 806, or aligned therewith. More generally, the control-line gap 803 may be aligned with the proximal end 2506 of the control line guide 2500, and thus either may be oriented in any way that is desired.

Figure 24:
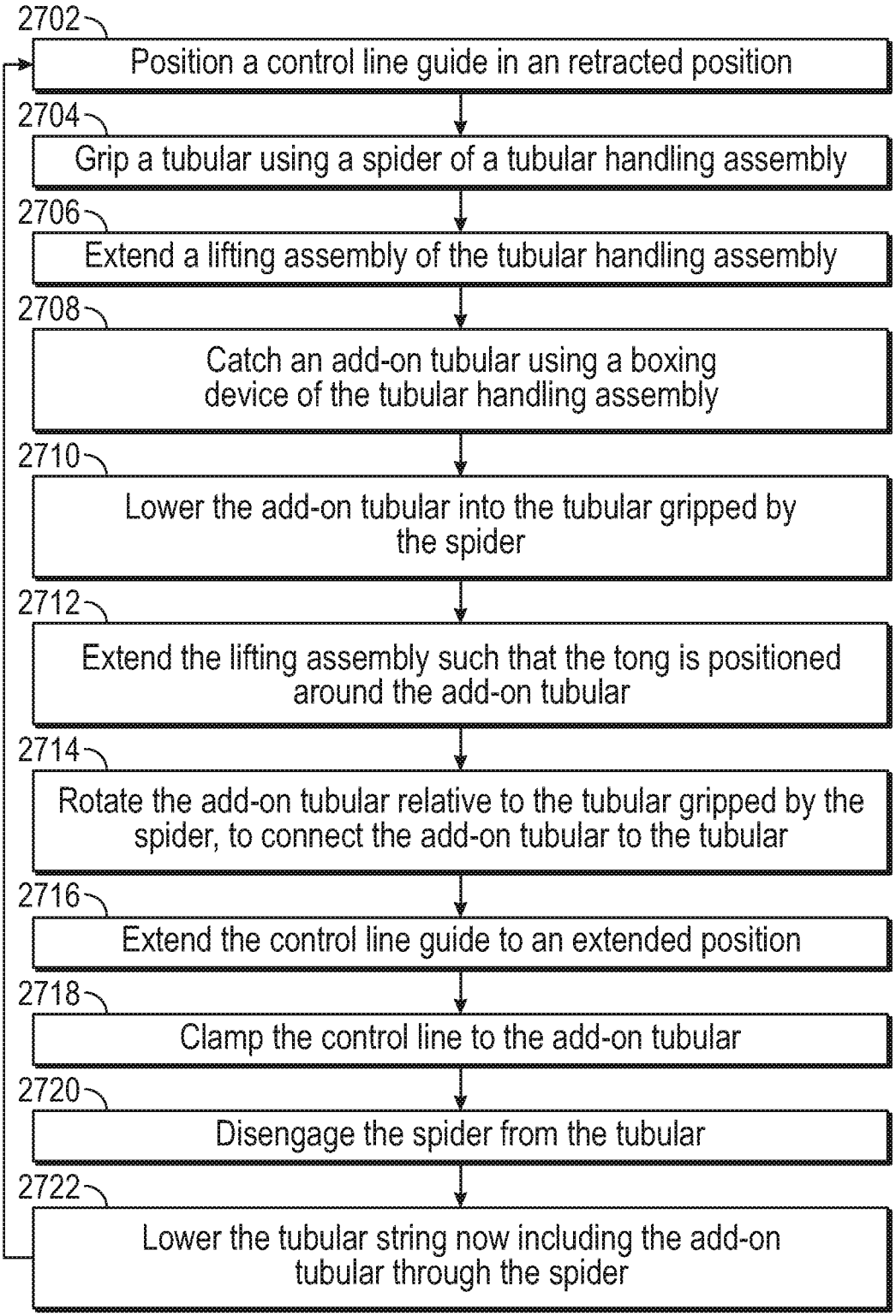
FIG. 24 illustrates a flowchart of a method for connecting together two tubulars and facilitating installation of a control line thereto using a tubular handling assembly that includes a control line guide, according to an embodiment.

FIG. 24 illustrates a flowchart of a method 2700 for operating a tubular handling system 2600 that includes the control line guide 2500 in order to connect together two tubulars and facilitate the installation of a control line thereto, according to an embodiment. Repetitive connection of add-on tubulars to tubulars supported in the spider results in the formation of a tubular string as described previously. Much of the operation of the tubular handling system 2600 has already been discussed above, e.g., with reference to FIGS. 16-17F, and descriptions of the operation that are redundant to those already provided above will largely be omitted. In addition, several of the stages of the method 2700 are shown, by way of example, in FIGS. 25A-25E, and reference will be made thereto in describing the method 2700.

Figure 25A:
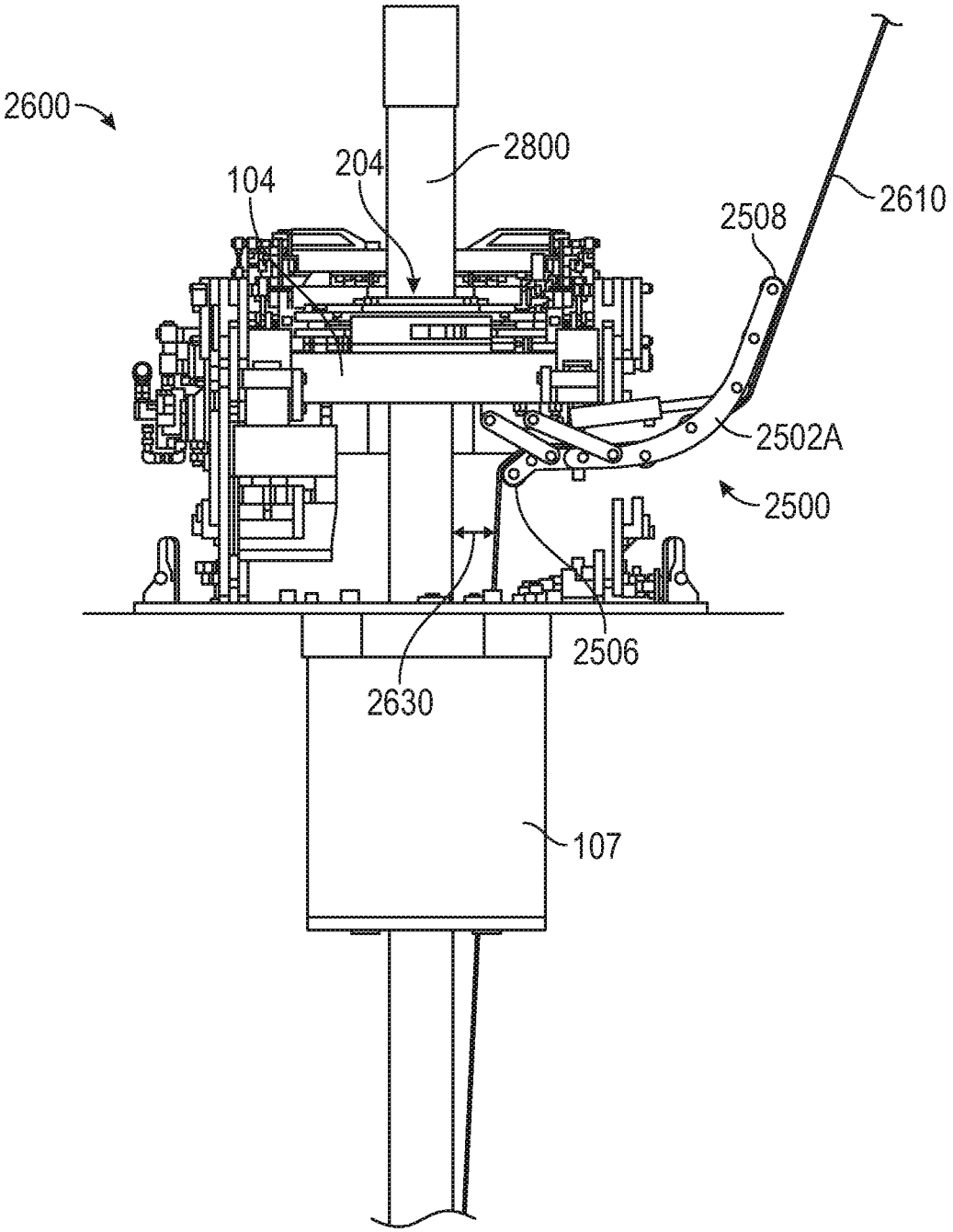
FIGS. 25A, 25B, 25C, 25D, and 25E illustrate the tubular handling assembly at various stages of the method of FIG. 24, according to an embodiment.

The method 2700 may begin by positioning the control line guide 2500 in an retracted position, as at 2702. This is shown in FIG. 25A. In this configuration, the control line guide 2500 maintains the control line clearance gap 2630 between the control line 2610 and a tubular 2800 that is received through the opening 204 of the tong 104. Further, maintaining the control line clearance gap 2630 may direct the control line 2610 through the control-line gap 803 (e.g., FIG. 22) of the spider 107, so as to protect the control line 2610 from being damaged by the slips 804. At this point, the method 2700 may also include gripping the tubular 2800 using the spider 107, as at 2704.

Figure 25B:
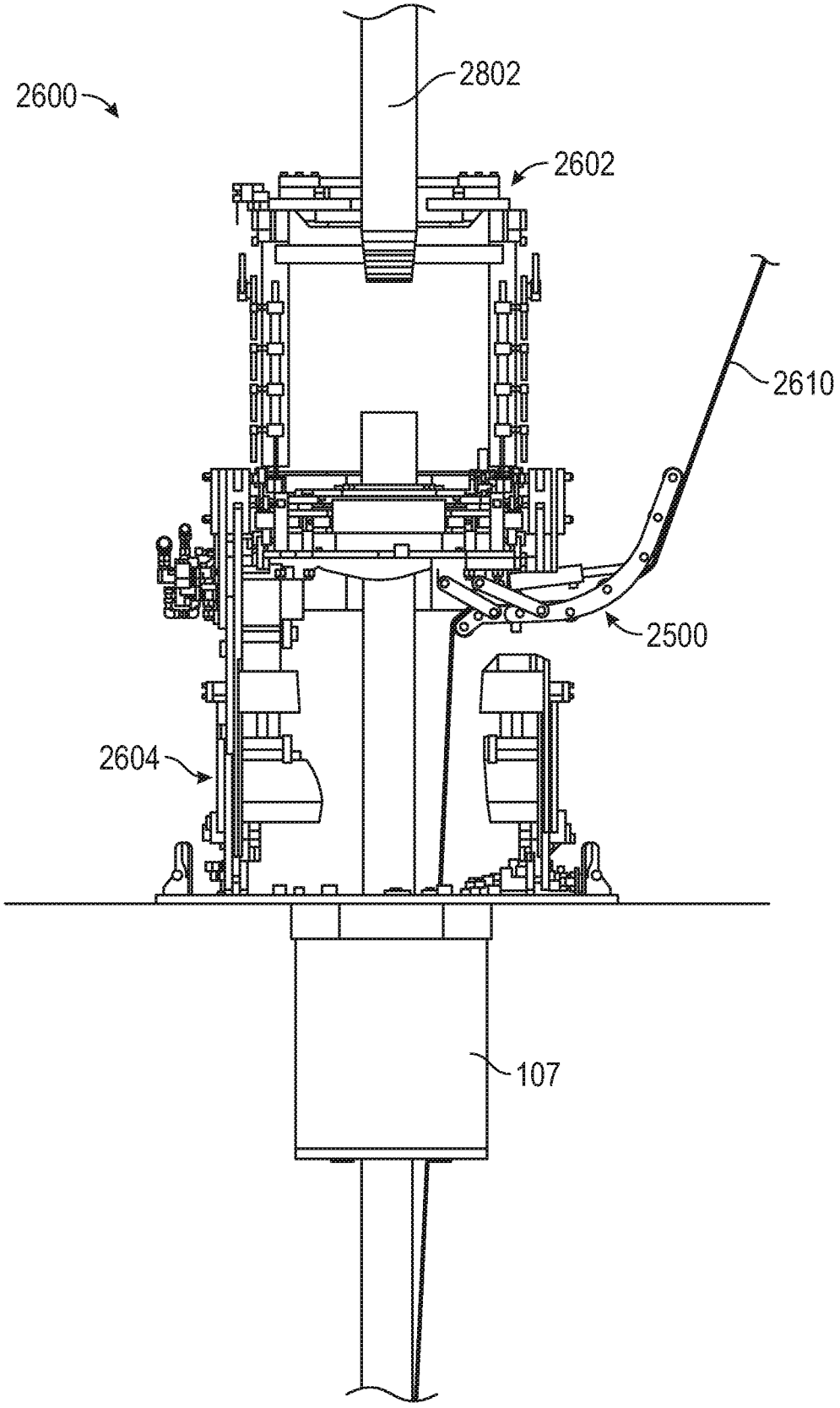
Figure 25C:
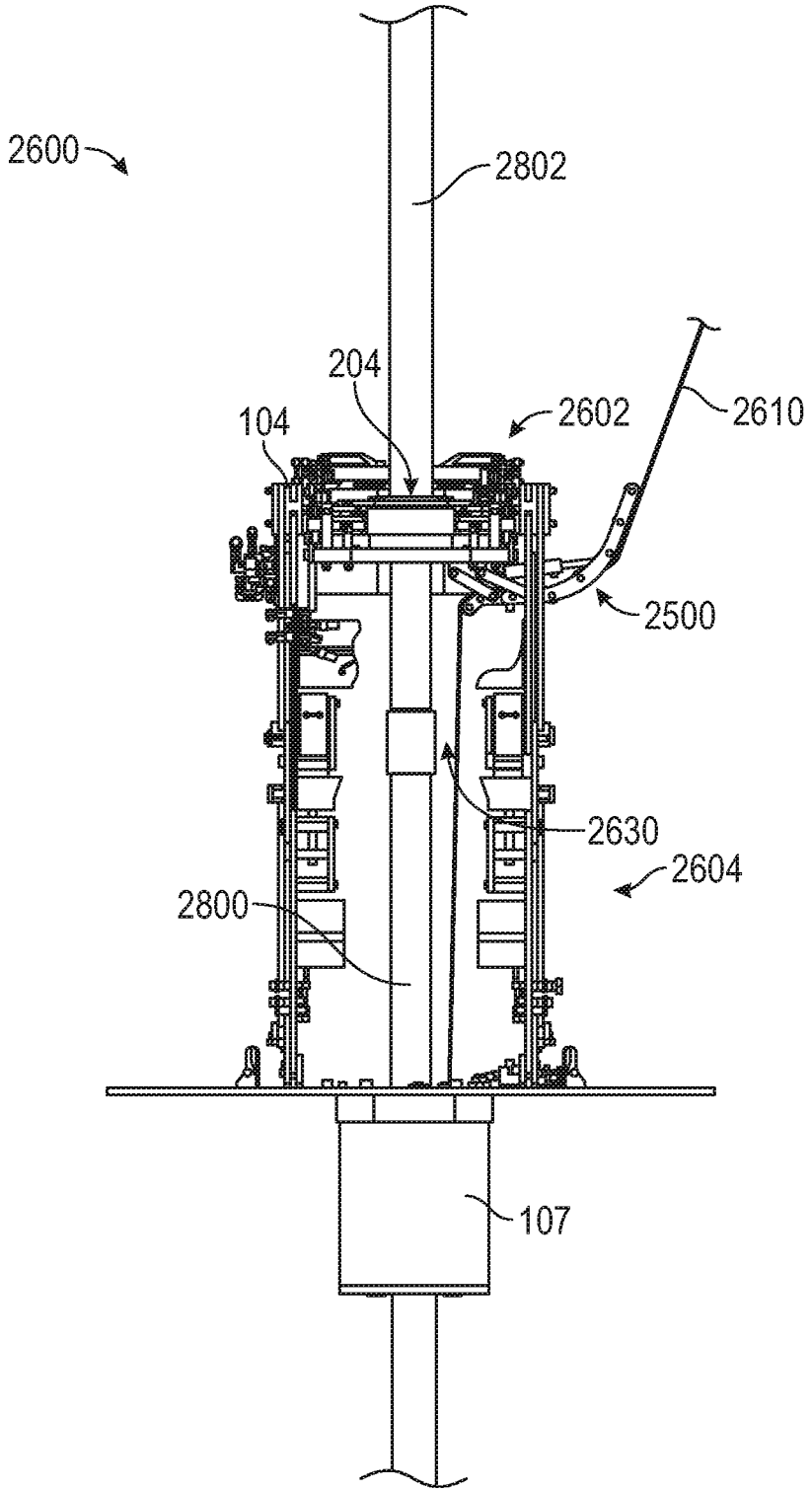

The method 2700 may then proceed to extending the lifting assembly 2604 of the tubular handling system upward to an intermediate position, as at 2706, and catching an add-on tubular 2802 in the boxing device 2602, as at 2708. This is shown in FIG. 25B. The add-on tubular 2802 may then be lowered into the tubular 2800, as at 2710. The lifting assembly 2604 may then be further extended, such that the tong 104 is positioned around the add-on tubular 2802, as at 2712. The tong 104 may then engage and rotate the add-on tubular 2802, to connect the add-on tubular 2802 to the tubular 2800, as at 2714. This is shown in FIG. 25C. During this connection process, the control line guide 2500 may remain in the retracted position, providing the control line clearance gap 2630, and thereby routing the control line 2610 into the control-line gap 803 in the spider 107.

Figure 25D:
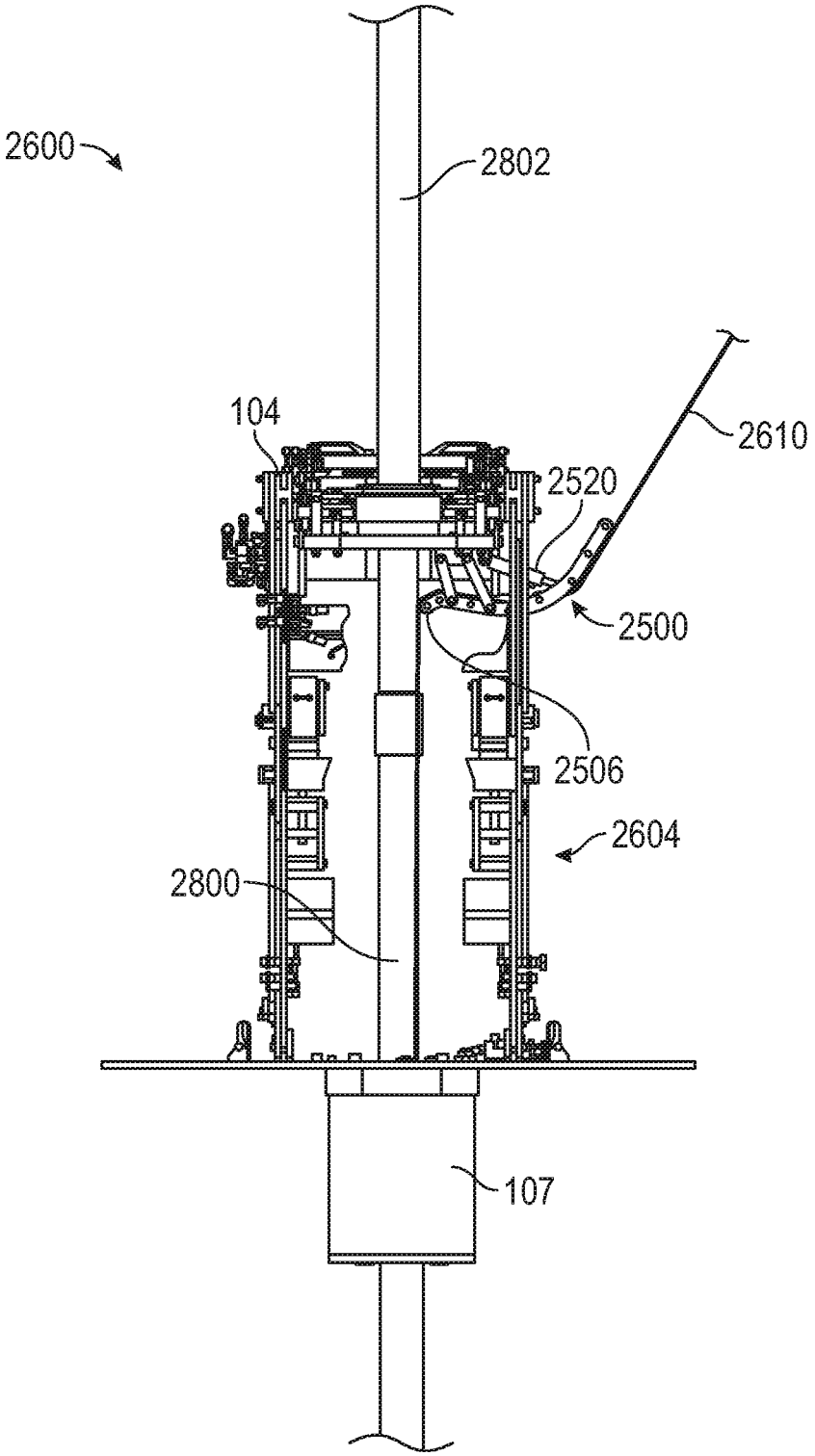

The control line guide 2500 may then be extended, as at 2716, e.g., by actuating the driver 2520. As shown in FIG. 25D, this may draw the proximal end 2506 of the control line guide 2500 toward the add-on tubular 2802, such that the control line clearance gap 2630 is reduced or eliminated.

Figure 25E:
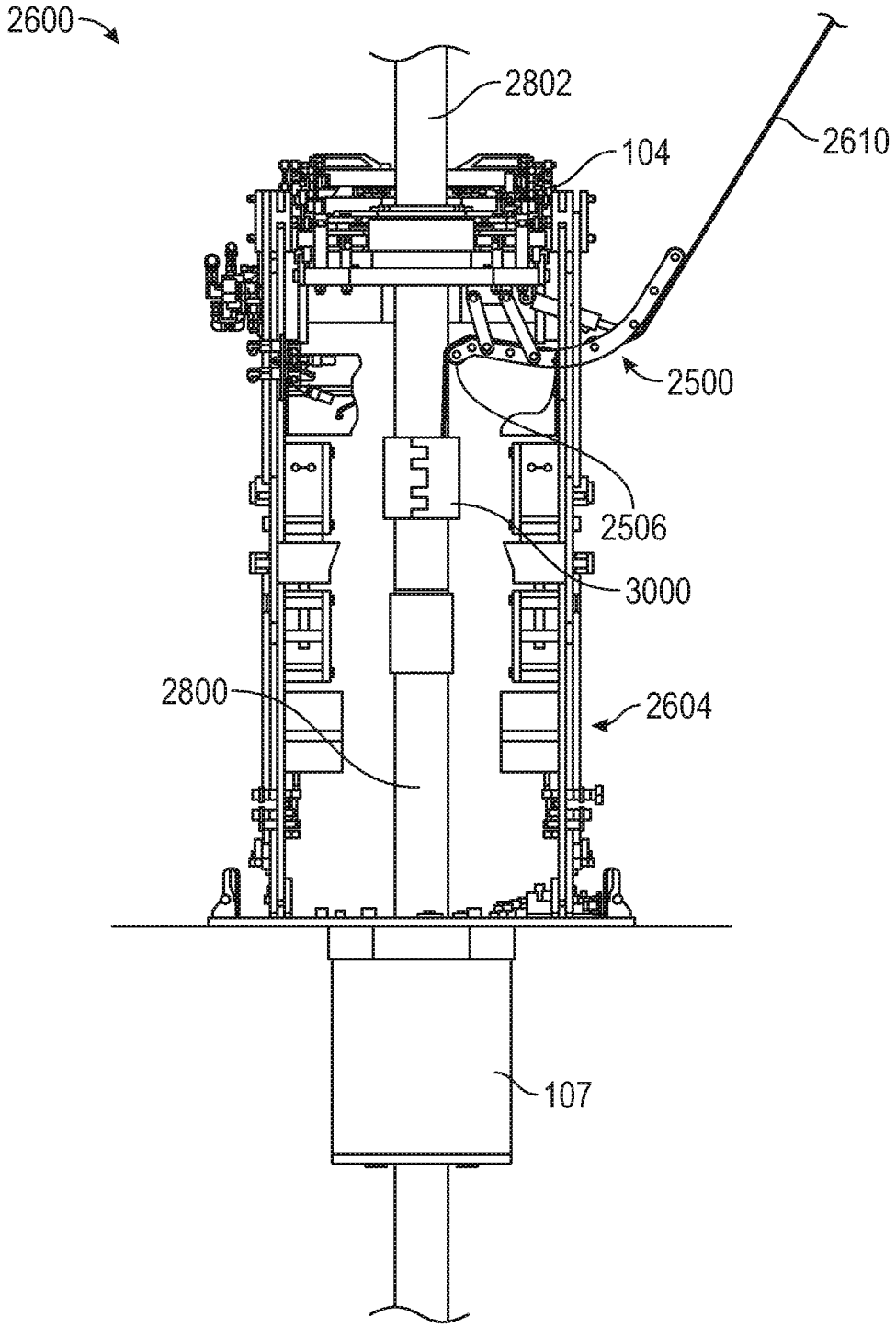

As shown in FIG. 25E, a control line clamp 3000 may then be coupled to the add-on tubular 2802 to secure the control line 2610 thereto, as at 2718. The control line clamp 3000 may be hinged, as shown, but may also any other suitable type of clamp 3000.

Before, during, or after extending the control line guide 2500 at 2716 and/or clamping the control line 2610 to the add-on tubular 2802, the method 2700 may include disengaging the spider 107 from the tubular 2800, as at 2720 (after an elevator or another tubular handling device is coupled to the add-on tubular 2802 to support the weight of the add-on tubular 2802, the tubular 2800, and any lengths of tubular connected thereto and previously deployed into the well). The add-on tubular 2802 and the tubular 2800 may then be lowered, as the lifting device 2604 is also lowered, until the tubular handling system 2600 is fully collapsed.

The spider 107 may then grip the add-on tubular 2802, and the process may repeat for the next add-on tubular.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A tubular handling system, comprising:

a power tong configured to engage and rotate an add-on tubular by applying a torque thereto, the power tong defining a central opening configured to receive the add-on tubular therethrough;

a spider disposed at a rig floor, the spider being configured to support a tubular string;

a lifting assembly coupled with the power tong and configured to move the power tong vertically with respect to the tubular string and the spider; and a control line guide coupled to the power tong such that the lifting assembly moving the power tong also moves the control line guide therewith, wherein the control line guide is movable between an extended position in which the control line guide is configured to guide a control line into close proximity to the add-on tubular, and a retracted position in which the control line guide is configured to maintain a lateral control line clearance gap between the control line and the add-on tubular.

2. The tubular handling system of claim 1, wherein the spider comprises slips configured to engage the add-on tubular, and a control-line gap defined radially outside of slips, and wherein the control line guide in the retracted position is configured to direct the control line into the control-line gap.

3. The tubular handling system of claim 1, wherein the control line guide comprises:

a pair of curved guide rails; and a plurality of rollers positioned between the guide rails, wherein the control line is positioned at least partially on the plurality of rollers.

4. The tubular handling system of claim 3, wherein the pair of curved guide rails each comprise a main curved portion that extends upwards and outwards from the power tong, and a downward curved portion that curves downward to a proximal end of the control line guide.

5. The tubular handling system of claim 3, wherein the control line guide comprises:

a driver configured to move the curved guide rails outward, relative to the central opening of the power tong, so as to move the control line guide to the retracted position, and to move the curved guide rails inward, relative to the central opening of the power tong, so as to move the control line guide to the extended position, relative to the power tong.

6. The tubular handling system of claim 5, wherein the driver comprises an extendable hydraulic cylinder, and wherein the control line guide comprises a linkage that pivotally connects the guide rails to an underside of the power tong.

7. The tubular handling system of claim 1, further comprising a boxing device coupled with the lifting assembly and movable vertically along with the power tong, the boxing device being pivotable with respect to the power tong and configured to align the tubular with respect to the power tong.

8. The tubular handling system of claim 1, further comprising a can disposed between the spider and a rotary, wherein the can is configured to transmit torque to the spider.

9. The tubular handling system of claim 1, wherein the lifting assembly comprises a plurality of arms that are pivotable to move the power tong vertically, a scissor jack arrangement, or a four-bar linkage arrangement.

10. The tubular handling system of claim 1, wherein the power tong comprises a plurality of engaging members, the plurality of engaging members being configured to move between an engaging position and a retracted position, the plurality of engaging members in the engaging position being configured to apply a torque to the tubular, and the plurality of engaging members in the retracted position being spaced radially apart from the tubular such that the power tong is vertically movable over a box-end connection of the tubular string.

11. The tubular handling system of claim 1, wherein the control line guide is mounted directly to a bottom of the power tong.

12. The tubular handling system of claim 1, further comprising a backup tong, the backup tong being configured to engage the tubular string and transmit a reactionary torque to the tubular string, the reactionary torque being generated in reaction to the torque applied by the power tong.

13. The tubular handling system of claim 12, further comprising a can in which the spider is received, wherein the lifting assembly is coupled directly to the can.

14. The tubular handling system of claim 1, wherein the power tong is only movable vertically.

15. A tubular handling system, comprising:

a power tong configured to engage and rotate an add-on tubular by applying a torque thereto, the power tong defining a central opening configured to receive the add-on tubular therethrough;

a spider disposed at a rig floor, the spider being configured to support a tubular string;

a lifting assembly coupled with the power tong and configured to move the power tong vertically with respect to the tubular string and the spider; and a control line guide coupled to the power tong, wherein the control line guide is movable between an extended position in which the control line guide is configured to guide a control line into close proximity to the add-on tubular, and a retracted position in which the control line guide is configured to maintain a lateral control line clearance gap between the control line and the add-on tubular, and wherein the spider is configured to transmit a reactionary torque to the tubular string, when supporting the tubular string, the reactionary torque being generated in reaction to torque applied by the power tong.

16. The tubular handling system of claim 15, wherein the lifting assembly transmits the reactionary torque from the power tong to the spider.

17. A method for handling tubulars, comprising:

positioning a control line guide of a tubular handling system in a retracted position such that a control line clearance gap is defined laterally between a control line that is run through the control line guide and at least part of a tubular string that is received through and engaged by a spider of the tubular handling system;

moving a power tong of the tubular handling system upwards along the tubular string, past an upper connection thereof, and around an add-on tubular to be connected to the tubular string, by expanding a lifting assembly of the tubular handling system and without laterally moving the power tong from around the tubular string;

rotating the add-on tubular using the power tong, to connect a lower connection of the add-on tubular to the upper connection of the tubular string, such that the add-on tubular becomes part of the tubular string;

extending the control line guide to an extended position such that the control line clearance gap is reduced or eliminated and at least a portion of the control line guide is brought into proximity with the tubular string;

disengaging the power tong from the add-on tubular;

lowering the power tong past the lower connection of the add-on tubular and the upper connection of the tubular string by collapsing the lifting assembly, without laterally moving the power tong from around the tubular string, such that the power tong is positioned proximal to the spider;

disengaging the spider from the tubular string; and lowering the tubular string, including the add-on tubular, through the spider and the power tong.

18. The method of claim 17, further comprising securing the control line to the add-on tubular after extending the control line guide to the extended position, wherein lowering the tubular string comprises lowering the control line guide.

19. The method of claim 17, wherein positioning the control line guide in the retracted position causes the control line to be received into a control-line gap defined through the spider and radially outwards of slips of the spider.

20. The method of claim 17, further comprising:

expanding a boxing device coupled to the power tong, such that a frame of the boxing device is moved away from the power tong;

catching the add-on tubular using the frame; and positioning the add-on tubular over the tubular string using the boxing device, before moving the power tong upwards along the tubular string, past the upper connection thereof, and around the add-on tubular.

21. The method of claim 20, wherein:

catching the add-on tubular comprises receiving the add-on tubular in a recess formed in the frame, and gripping the add-on tubular using gripping members of the boxing device;

positioning the add-on tubular comprises pivoting one or more legs of the boxing device with respect to the power tong, such that the add-on tubular is generally coaxial with the tubular string; and the method further comprises lowering the add-on tubular after positioning the add-on tubular such that the add-on tubular engages the tubular string.

22. The method of claim 17, further comprising moving the power tong upwards by expanding the lifting assembly, such that the power tong is below the upper connection, after positioning the add-on tubular over the tubular string using a boxing device of the tubular handling system, and before moving the power tong up around the add-on tubular.

23. The method of claim 17, further comprising engaging the tubular string using a backup tong, such that the backup tong transmits a reactionary torque of the power tong to the tubular string.

* * * * *